US005437965A

United States Patent [19]

Uchida et al.

[11] Patent Number: 5,437,965

[45] Date of Patent: Aug. 1, 1995

[54] SILVER HALIDE COLOR PHOTOGRAPHIC MATERIAL

[75] Inventors: Minoru Uchida; Toshio Kawagishi; Shunichi Tomita, all of Kanagawa, Japan

[73] Assignee: Fuji Photo Film Co., Ltd., Kanagawa, Japan

[21] Appl. No.: 359,866

[22] Filed: Dec. 20, 1994

Related U.S. Application Data

[63] Continuation of Ser. No. 37,521, Mar. 25, 1993, abandoned, which is a continuation of Ser. No. 792,654, Nov. 15, 1991, abandoned.

[30] Foreign Application Priority Data

Nov. 15, 1990 [JP] Japan ..... 2-310010

[51] Int. Cl.[6] ..... G03C 1/46

[52] U.S. Cl. ..... 430/504; 430/505; 430/544; 430/362; 430/358; 430/956; 430/957

[58] Field of Search ..... 430/504, 505, 544, 956, 430/957, 362, 558

[56] References Cited

U.S. PATENT DOCUMENTS

| | | | |
|---|---|---|---|
| 4,248,962 | 2/1981 | Lau | 430/382 |
| 4,663,271 | 5/1987 | Nozawa et al. | 430/503 |
| 4,705,744 | 11/1987 | Sasaki et al. | 430/505 |
| 4,994,358 | 2/1991 | Deguchi et al. | 430/547 |
| 5,053,324 | 10/1991 | Sasaki et al. | 430/504 |
| 5,077,182 | 12/1991 | Sasaki et al. | 430/504 |

FOREIGN PATENT DOCUMENTS

| | | |
|---|---|---|
| 61-028947 | 2/1986 | Japan . |
| 63-089850 | 4/1988 | Japan . |
| 1-164943 | 6/1989 | Japan . |

*Primary Examiner*—Charles L. Bowers, Jr.
*Assistant Examiner*—John A. McPherson
*Attorney, Agent, or Firm*—Sughrue, Mion, Zinn, Macpeak & Seas

[57] ABSTRACT

A silver halide color photographic material comprising a support having thereon at least one yellow coupler-containing blue-sensitive silver halide emulsion layer (BL), at least one magenta coupler-containing green-sensitive silver halide emulsion layer (GL) and at least one cyan coupler-containing red-sensitive silver halide emulsion layer (RL); wherein the weight-averaged wavelength of the spectral sensitivity distribution of GL ($\overline{\lambda}_G$) of the photographic material is between 520 nm and 580 nm (520 nm$\leqq\overline{\lambda}_G\leqq$580 nm), the weight-averaged wavelength of the spectral sensitivity distribution of RL ($\lambda_R$) of the photographic material is between 590 nm and 650 nm (590 nm$\leqq\overline{\lambda}_R\leqq$650 nm), and the weight-averaged wavelength of the spectral sensitivity distribution of BL ($\overline{\lambda}_B$) of the photographic material is between 430 nm and 480 nm (430 nm$\leqq\overline{\lambda}_B\leqq$480 nm); wherein the photographic material satisfies at least one of the requirements (a), (b) and (c) as defined in claim 1; wherein the photographic material contains at least one compound represented by formula (P-2) or (P-3) as recited in claim 1; and wherein a maximum interlayer effect to the RL at the weight-averaged wavelength $\lambda_R$ is imparted from at least one of the layers selected from the group consisting of the BL and GL, and the difference between the weight-averaged wavelength in the color sensitivity distribution of GL ($\overline{\lambda}_G$) and the weight-averaged wavelength of the negative interlayer effect relative to RL $\overline{\lambda}_{-R}$ is 5 nm or more $\overline{\lambda}_G-\overline{\lambda}_{-R}\geqq$5 nm).

7 Claims, 3 Drawing Sheets

SILVER HALIDE COLOR PHOTOGRAPHIC MATERIAL

This is a Continuation of Application Ser. No. 08/037,521 filed on Mar. 25, 1993, (now abandoned) which is a continuation of prior parent Application Ser. No. 07/792,654 filed Nov. 15, 1991 (now abandoned).

FIELD OF THE INVENTION

The present invention relates to a silver halide color photographic material having excellent color reproducibility, color image storability and storage stability.

BACKGROUND OF THE INVENTION

It is known to utilize an interlayer restraining effect as a means for improving the color reproducibility of a color photographic material. In a color negative photographic material, imparting a development restraining effect from the green-sensitive layer to the red-sensitive layer lowers the coloration of the red-sensitive layer on exposure to white light than is the coloration of the same layer on exposure to red light. Since the gradation of a color negative paper system is balanced so that exposure of the paper to white light results in a gray color in the color print, the above-described interlayer effect causes cyan coloration of a higher density on exposure to red light in the print than by gray exposure. As a result, red reproduction of a higher saturation degree is possible in the print by restraining the cyan coloration thereon. In the same way, the development restraining effect from the green-sensitive layer to the red-sensitive layer in a color photographic material gives a higher saturation degree for green reproduction.

One means of elevating the interlayer effect is the known method of using iodide ions which are released from silver halide emulsions during development. Precisely, in the photographic material to be processed by this method, the silver iodide content in the interlayer restraining effect donor layer is increased and that in the receptor layer is reduced. Another method of elevating the interlayer restraining effect is illustrated in JP-A-50-2537 (the term "JP-A" as used herein means an "unexamined published Japanese patent application"), in which a coupler capable of releasing a development inhibitor by reaction with an oxidation product of a para-phenylene diamine developing agent in a color developer is added to an interlayer restraining effect donor layer. Still another method of increasing the interlayer effect is a so-called automatic masking method in which a colored coupler is added to a colorless coupler so as to mask any unnecessary absorption of the colored dye from the colorless coupler. In this method of using such a colored coupler, the amount of the colored coupler to be added may be increased to achieve more masking than the masking necessary for absorbing the unnecessary absorption from the colorless coupler to thereby accomplish the same effect as the intended interlayer restraining effect.

Where the saturation of the primary colors of red, green and blue is increased using these methods, a drawback occurs in that the yellowish to cyanic green color hue can not be reproduced faithfully. Under the situation, U.S. Pat. No. 4,705,744 discloses a technique to overcome this drawback. In accordance with the disclosed technique, both the color sensitivity of the color photographic material and the interlayer effect-donating DIR compound to be added to the material are specifically tailored to noticeably improve the color reproducibility of the material.

On the other hand, as a means of improving the color reproducibility of a color photographic material, improvement in the coloring dyes in the material has been effected. In particular, pyrazoloazole compounds are known as compounds forming a magenta dye having an excellent hue with little unnecessary absorption. However, all examples of the magenta coloring DIR compounds as illustrated in U.S. Pat. No. 4,705,744 and in JP-A-63-89850 above are 5-pyrazolone compounds, which are not always satisfactory in terms of color reproducibility. In addition, it has further been found that such 5-pyrazolone compounds have another drawback of causing extreme color intensification during storage after development, and especially under high-temperature and high-humidity conditions.

JP-A-61-28947, JP-A-62-24252 and JP-A-1-164943 illustrate pyrazoloazole compounds which are chemically stable and which are effective for improving color reproducibility.

However, it has also been found that the storage stability of these pyrazoloazole compounds in photographic materials is still insufficient.

SUMMARY OF THE INVENTION

An object of the present invention is to provide a color photographic material having excellent color reproducibility, color image storability and storage stability, which contains a particular pyrazoloazole compound having a high storability in a layer structure involving optimized color sensitivity and interlayer effect.

The above object of the present invention has been attained by a silver halide color photographic material comprising a support having thereon at least one yellow coupler-containing blue-sensitive silver halide emulsion layer (BL), at least one magenta coupler-containing green-sensitive silver halide emulsion layer (GL) and at least one cyan coupler-containing red-sensitive silver halide emulsion layer (RL); wherein in the color photographic material the weight-averaged wavelength of the spectral sensitivity distribution of GL ($\bar{\lambda}_G$) falls between 520 nm and 580 nm (520 nm$\leqq\bar{\lambda}_G\leqq$580 nm), the weight-averaged wavelength of the spectral sensitivity distribution of RL ($\bar{\lambda}_R$) falls between 590 nm and 650 nm (590 nm$\leqq\bar{\lambda}_R\leqq$650 nm), and the weight-averaged wavelength of the spectral sensitivity distribution of BL ($\bar{\lambda}_B$) falls between 430 nm and 480 nm (430 nm$\leqq\bar{\lambda}_B\leqq$480 nm); and wherein the color photographic material satisfies at least one of the following requirements (a), (b) and (c):

(a) the weight-averaged wavelength of the negative interlayer effect relative to RL ($\bar{\lambda}_{-R}$) falls between 490 nm and 560 nm (490 nm$\leqq\bar{\lambda}_{-R}\leqq$560 nm), (b) the weight-averaged wavelength of the negative interlayer affect relative to GL ($\bar{\lambda}_{-G}$) falls between 400 nm and 500 nm (400 nm$\leqq\bar{\lambda}_{-G}\leqq$500 nm) and/or between 570 nm and 670 nm (570 nm $\leqq\bar{\lambda}_{-G}\leqq$670 nm), and (c) the weight-averaged wavelength of the negative interlayer effect relative to BL ($\bar{\lambda}_{-B}$) falls between 520 nm and 590 nm (520 nm $\leqq\bar{\lambda}_{-B}\leqq$ 590 nm);

and wherein at least one material capable of producing an interlayer effect is a compound of formula (I):

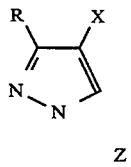

(I)

where

R represents a hydrogen atom or a substituent;

Z represents a nonmetallic atomic group necessary for forming a 5-membered azole ring containing from 2 to 4 nitrogen atoms, and the azole ring may optionally have substituent(s); and X represents a group which may split off by the coupling reaction with an oxidation product of a developing agent to form a development inhibitor or a precursor thereof, or a group which, after splitting by the coupling reaction, may further react with another molecule of the oxidation product of a developing agent to form a development inhibitor or a precursor thereof.

DETAILED DESCRIPTION OF THE INVENTION

Figure 1:
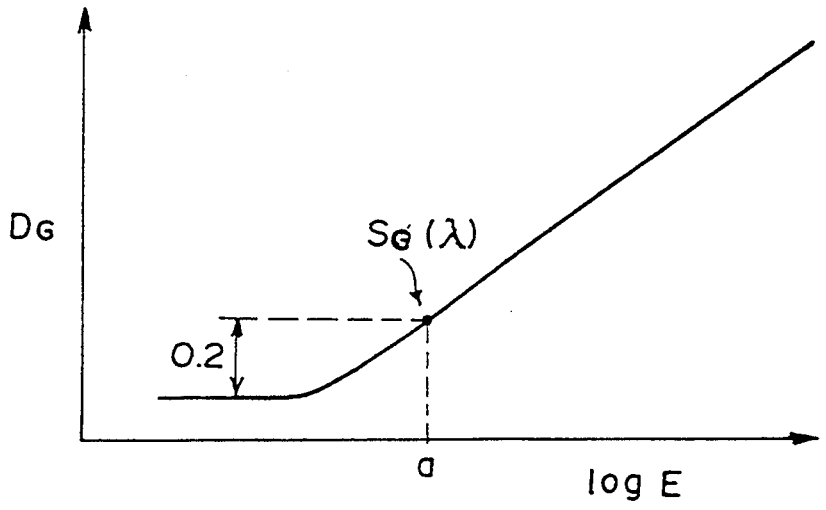
FIG. 1 shows a characteristic curve of a green-sensitive layer at $\bar{\lambda}$.

Compounds of the formula (I) to be used in the present invention are explained in greater detail below.

Preferred coupler skeletons of formula (I) are a 1H-imidazo[1,2-b]pyrazole skeleton, a 1H-pyrazolo[1,5b][1,2,4]triazole skeleton, a 1H-pyrazolo[5,1-c][1,2,4]triazole skeleton and a 1H-pyrazolo[1,5-d]tetrazole skeleton of the following formulae (P-1), (P-2), (P-3) and (P-4), respectively.

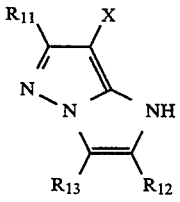

(P-1)

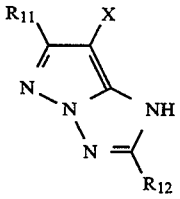

(P-2)

-continued

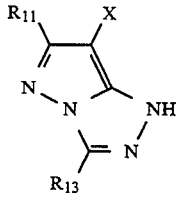

(P-3)

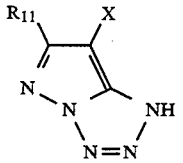

(P-4)

Suitable $R_{11}$, $R_{12}$, $R_{13}$ and X substituents in these formulae are explained in detail hereunder.

$R_{11}$ represents a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, an ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic-oxy group, an azo group, an acyloxy group, a carbamoyloxy group, a silyloxy group, an aryloxycarbamoylamino group, an imido group, a heterocyclic-thio group, a sulfinyl group, a phosphonyl group, an aryloxycarbonyl group, an acyl group, or an azolyl group; and $R_{11}$ may be a divalent group to form a bis form of the compound.

More precisely, $R_{11}$ represents a hydrogen atom, a halogen atom (e.g., chlorine, bromine), an alkyl group (e.g., a linear or branched alkyl, aralkyl, alkenyl, alkynyl, cycloalkyl or cycloalkenyl group having from 1 to 31 carbon atoms, such as methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]dodecanamido}phenyl}propyl, 2-ethoxytridecyl, trifluoromethyl, cyclopentyl, 3-(2,4-di-t-amylphenoxy)propyl), an aryl group (e.g., phenyl, 4-t-butylphenyl, 2,4-di-t-amylphenyl, 4-tetradecanamidophenyl), a heterocyclic group (e.g., 2-furyl, 2-thienyl, 2-pyrimidinyl, 2-benzothiazolyl), a cyano group, a hydroxy group, a nitro group, a carboxyl group, an amino group, an alkoxy group (e.g., methoxy, ethoxy, 2-methoxyethoxy, 2-dodecylethoxy, 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, 3-methoxycarbamoylphenoxy), an acylamino group (e.g., acetamido, benzamido, tetradecanamido, 2-(2,4-di-t-amylphenoxy)butanamido, 4-(3-t-butyl-4-hydroxyphenoxy)-butanamido, 2-{4-(4-hydroxyphenylsulfonyl)phenoxy}dodecanamido), an alkylamino group (e.g., methylamino, butylamino, dodecylamino, diethylamino, methylbutylamino), an anilino group (e.g., phenylamino, 2-chloroanilino, 2-chloro-5-tetradecanaminoanilino, 2-chloro-5-dodecyloxycarbonylanilino, N-acetylanilino, 2-chloro-5-{α-(3-t-butyl-4-hydroxyphenoxy)dodecanamido}anilino), a ureido group (e.g., phenylureido, methylureido, N,N-dibutylureido), a sulfamoylamino group (e.g., N,N-dipropylsulfamoylamino, N-methyl-N-decylsulfamoylamino), an alkylthio group (e.g., methylthio, octylthio, tetradecylthio, 2-phenoxyethylthio, 3-phenoxypropylthio, 3-(4-t-butylphenoxy)propylthio), an arylthio group (e.g., phenylthio, 2-butoxy-5-t-octylphenylthio, 3-pentadecylphenylthio, 2-carboxyphenylthio, 4-tetradecanamidophenylthio), an alkoxycarbonylamino group (e.g., methoxycarbonylamino, tetradecyloxycarbonylamino), a sulfonamido group (e.g., methanesulfonamido, hexadecanesulfonamido, benzenesulfonamido, p-toluenesulfonamido, octadecanesulfonamido, 2-methyloxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, N-{3-(2,4-di-t-amylphenoxy)propyl}carbamaoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (e.g., methanesulfonyl, octanesulfonyl, benzenesulfonyl, toluenesulfonyl), an alkoxycarbonyl group (e.g., methoxycarbonyl, butyloxycarbonyl, dodecyloxycarbonyl, octadecyloxycarbonyl), a heterocyclic-oxy group (e.g., 1-phenyltetrazol-5-oxy, 2-tetrahydropyranyloxy), an azo group (e.g., phenylazo, 4-methoxyphenylazo, 4-pyvaloylaminophenylazo, 2-hydroxy-4-propanoylphenylazo), an acyloxy group (e.g., acetoxy), a carbamoyloxy group (e.g., N-methylcarbamoyloxy, N-phenylcarbamoyloxy), a silyloxy group (e.g., trimethylsilyloxy, dibutylmethylsilyloxy), an aryloxycarbonylamino group (e.g., phenoxycarbonylamino), an imido group (e.g., N-succinimido, N-phthalimido, 3-octadecenylsuccinimido), a heterocyclic-thio group (e.g., benzothiazolylthio, 2,4-diphenoxy-1,3,5-triazole-6-thio, 2-pyridylthio), a sulfinyl group (e.g., dodecanesulfinyl, 3-pentadecylphenylsulfinyl, 3-phenoxypropylsulfinyl), a phosphonyl group (e.g., phenoxyphosphonyl, octyloxyphosphonyl, phenylphosphonyl), an aryloxycarbonyl group (e.g., phenoxycarbonyl), an acyl group (e.g., acetyl, 3-phenylpropanoyl, benzoyl, 4-dodecyloxybenzoyl), or an azolyl group (e.g., imidazolyl, pyrazolyl, 3-chloropyrazol-1-yl, triazolyl). Of these groups, those which may be substituted may have one or more substituents selected from organic substituents and halogen atoms, bonded thereto via a carbon atom, an oxygen atom, a nitrogen atom or a sulfur atom.

Preferably, $R_{11}$ represents a hydrogen atom, an alkyl group, an aryl group, an alkoxy group, an aryloxy group, an alkylthio group a ureido group, a urethane group or an acylamino group.

$R_{12}$ may represent the same substituent as that described above for $R_{11}$; and $R_{12}$ is preferably a hydrogen atom, an alkyl group, an aryl group, a heterocyclic group, an alkoxycarbonyl group, a carbamoyl group, a sulfamoyl group, a sulfinyl group, an acyl group, or a cyano group.

$R_{13}$ may also represent the same substituents as described for $R_{11}$; and $R_{13}$ is preferably a hydrogen atom, an alkyl group, an aryl group, a heterocyclic group, an alkoxy group, an aryloxy group, an alkylthio group, an arylthio group, an alkoxycarbonyl group, a carbamoyl group, or an acyl group. More preferably, $R_{13}$ is an alkyl group, an aryl group, a heterocyclic group, an alkylthio group, or an arylthio group.

X preferably represents a group of formula (X-1):

$$-\{(L_1)_a-(B)_m\}_p-(L_2)_n-DI \qquad (X\text{-}1)$$

where $L_1$ represents a group capable of splitting off from the coupler residual group at the left-side bond of $L_1$ in formula (X-1), followed by cleaving the right-side bond of $L_1$ (bonding to $(B)_m$) thereof;

B represents a group capable of cleaving the right-side bond of B in formula (X-1) by reaction with an oxidation product of a developing agent;

$L_2$ represents a group capable of splitting off from the formula (X-1) at the left-side bond of $L_2$ in formula (X-1), followed by cleaving the right-side bond (bonding to DI) thereto;

DI represents a development inhibitor residue;

a, m and n each represent 0 or 1; and p represents an integer of from 0 to 2; provided that when p is 2, then the $\{(L_1)_a-(B)_m\}p$ groups are the same or different.

The reaction releasing DI from the compound of formula (X-1) during development may be represented by, for example, the following reaction scheme, exemplified where p=1.

$$A-(L_1)_a-(B)_m-(L_2)_n-DI \xrightarrow{QDI^+}$$

$$(L_1)_a-(B)_m-(L_2)_n-DI \longrightarrow$$

$$(B)_m-(L_2)_n-DI \xrightarrow{QDI^+} (L_2)_n-DI \longrightarrow DI$$

In the reaction scheme, $L_1$, a, B, m, $L_2$, n and DI have the same meaning as in formula (X-1); and $QDI^+$ means an oxidation product of a developing agent. A represents the above-mentioned pyrazoloazole magenta coupler residue of a moiety of formula (I) without X.

In formula (X-1), the $L_1$ and $L_2$ linking groups include, for example, a group which splits off by a hemiacetal cleavage reaction as described in U.S. Pat. Nos. 4,146,396, 4,652,516 and 4,698,297; a timing group which splits off by an intramolecular nucleophilic cleavage reaction as described in U.S. Pat. No. 4,148,962; a timing group which splits off by an electron transfer cleavage reaction as described in U.S. Pat. Nos. 4,409,323 and 4,421,845; a group which splits off by an iminoketal hydrolysis cleavage reaction as described in U.S. Pat. No. 4,546,073; and a group which splits off by an ester hydrolysis cleavage reaction as described in German Patent (OLS) No. 2,626,317. $L_1$ and $L_2$ each bond to A or $A-(L_1)_a-(B)_m$ via a hetero atom, preferably an oxygen, sulfur or nitrogen atom, present therein.

Preferred examples of $L_1$ and $L_2$ are described below.

(1) Groups which split off from the skeleton by a hemiacetal cleavage reaction:

Examples of such groups are described in, for example, U.S. Pat. No. 4,146,396 and JP-A-60-249148 and JP-A-60-249149. These are, for example, groups of the following formula (T-1), in which the symbol (*) indicates the left-side bond of $L_1$ or $L_2$ in formula (X-1), and the symbol (**) indicates the right-side bond of $L_1$ or $L_2$ in formula (X-1).

(T-1)

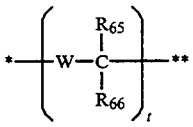

where

W represents an oxygen, a sulfur atom, or $-N(R_{67})-$;

$R_{65}$ and $R_{66}$ each represents a hydrogen atom, or a substituent;

$R_{67}$ represents a substituent; and t represents 1 or 2, and when t is 2, the $(-W-C(R_{65})(R_{66})-)$ groups are the same or different.

When $R_{65}$ and $R_{66}$ each represents a substituent, typical examples of $R_{67}$ substituent are $R_{69}-$, $R_{69}CO-$, $R_{69}SO_2-$, $(R_{69})(R_{70})N-CO-$, or $(R_{69})(R_{70})NSO_2-$. $R_{69}$ represents an aliphatic group, an aromatic group, or a heterocyclic group; and $R_{70}$ represents an aliphatic group, an aromatic group, a heterocyclic group, or a hydrogen atom. $R_{65}$, $R_{66}$ and $R_{67}$ each may also be a divalent group bonded to each other to form a cyclic structure. Specific examples of groups of formula (T-1) are set forth below.

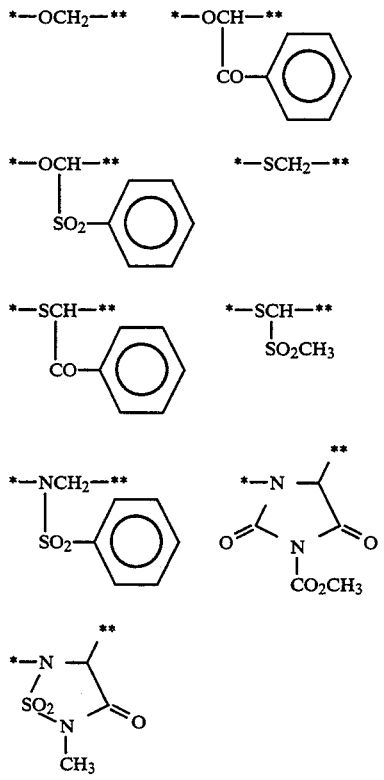

(2) Groups which split off from the skeleton by an intramolecular nucleophilic substitution cleavage reaction:

For instance, an example includes a timing group as described in U.S. Pat. No. 4,248,962, which is represented by the following formula (T-2):

$$*-Nu-Link-E-** \quad (T-2)$$

where the symbols (*) and (**) have the same meaning as in formula (T-1);

Nu represents a nucleophilic group, and examples of nucleophiles therein are an oxygen atom and a sulfur atom;

E represents an electrophilic group, which is a group nucleophilically attacked by Nu to cleave the bond (**); and Link represents a linking group for sterically linking Nu and E with each other so that an intramolecular nucleophilic substitution reaction may occur therebetween.

Specific examples of groups of formula (T-2) are described below.

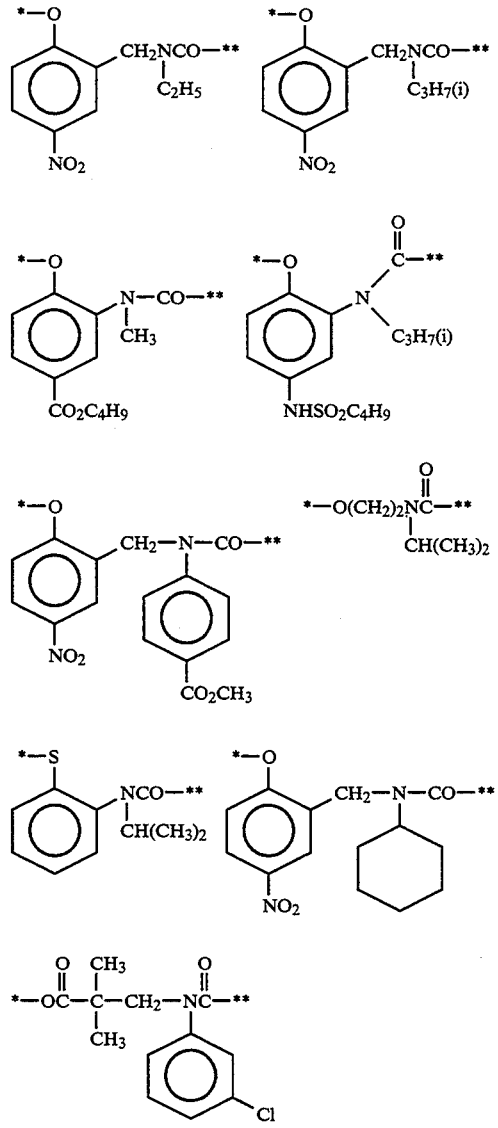

(3) Groups which split off from the skeleton by an electron transfer reaction along a conjugated system in the formula:

For instance, examples include the groups as described in U.S. Pat. Nos. 4,409,323 and 4,421,845, which are represented by the following formula (T-3):

$$*-W-(V_1=V_2)_t-CH_2-** \quad (T-3)$$

where $V_1$ and $V_2$ each represents $\equiv C-R_{65}$ or a nitrogen atom; and (*), (**), W, $R_{65}$ and t have the same meaning as in formula (T-1). Specific examples of groups of formula (T-3) are described below.

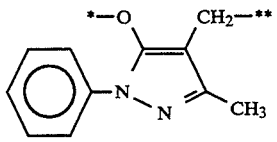

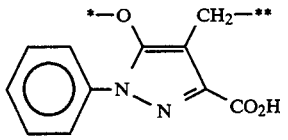

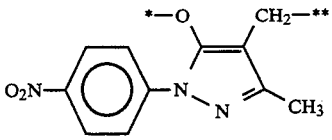

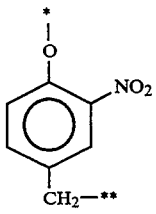

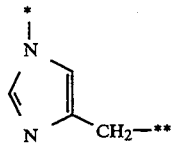

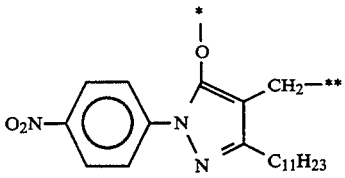

(4) Groups which split off from the skeleton by an ester hydrolysis:

For instance, examples include the linking groups as described German Patent (OLS) No. 2,626,315, which are represented by the following formulae (T-4) and (T-5):

$$*\text{—O—CO—}^{**} \quad \text{(T-4)}$$

$$*\text{—S—CS—}^{**} \quad \text{(T-5)}$$

where (*) and (**) have the same meaning as in formula (T-1).

(5) Groups which split off from the skeleton by an iminoketal cleavage reaction:

For instance, examples include linking groups described in U.S. Pat. No. 4,546,073, which are represented by the following-formula (T-6):

$$*\text{—W—C(=N—R}_{68}\text{)—}^{**} \quad \text{(T-6)}$$

where (*), (**) and W have the same meaning as in formula (T-1); and $R_{68}$ has the same meaning as $R_{67}$.

Specific examples of groups of formula (T-6) are described below.

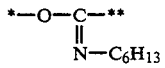

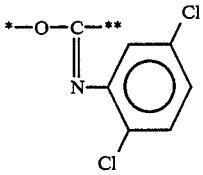

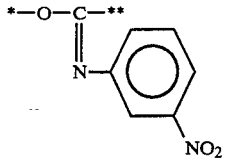

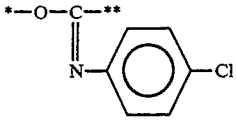

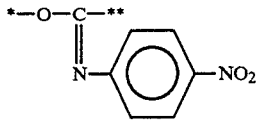

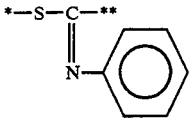

In formula (X-1), the group (B) is more specifically represented by the following formula (B-1), (B-2), (B-3) or (B-4):

$$*\text{—}X_1\text{—}(X_2\text{=}X_3)_b\text{—}X_4\text{—H} \quad \text{(B-1)}$$

In formula (B-1), the symbol (*) represents the position which is bonded to the left side of B in formula (X-1); and the symbol () represents the position which is bonded to the right side of B in formula (X-1). $X_1$ and $X_4$ each represent an oxygen atom or $=N—SO_2R_{71}$ (where $R_{71}$ represents an aliphatic group, an aromatic group or a heterocyclic group); $X_2$ and $X_3$ each represents a methine group or a nitrogen atom; and b represents an integer of from 1 to 3. At least one of the $(X_2)$'s in b and the $(X_3)$'s in b is a methine group with the bond (). Where b is a plural number, the $(X_2)$'s and the $(X_3)$'s are the same or different. Where $X_2$ and $X_3$ each is a substituted methine group or bonded to each other to form a cyclic structure (for example, a benzene ring or a pyridine ring). After the group of formula (B-1) has been cleaved at the bond (*), a compound meeting the Kendall-Pelz law (see T. H. James' *The Theory of the Photographic Process* (4th Ed., published by Macmillan Publishing Co., Inc. page 299)) is formed, which reacts with an oxidation product of a developing agent to be oxidized.

Specific examples of groups of formula (B-1) are described below.

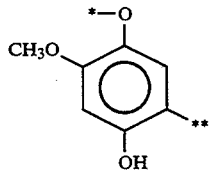

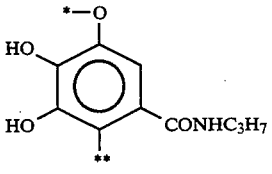

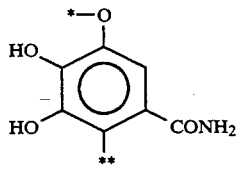

-continued

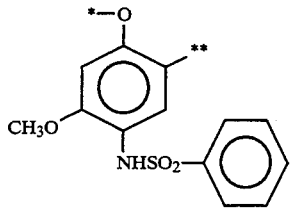

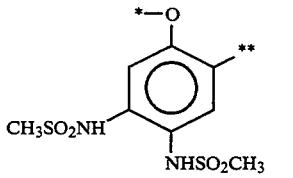

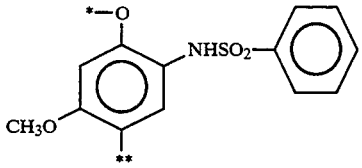

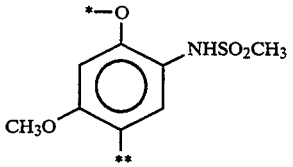

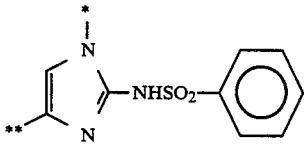

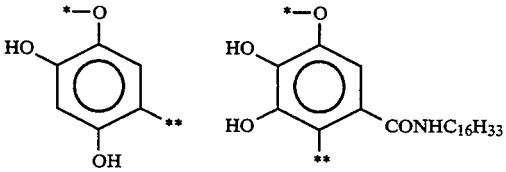

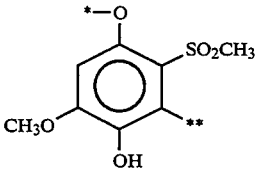

(B-2)

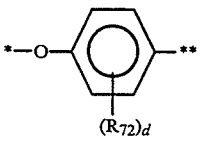

(B-3)

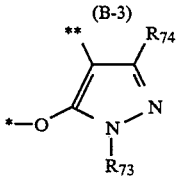

In these formulae, the symbols (*) and () have the same meaning as those in formula (B-1); and $R_{72}$, $R_{73}$ and $R_{74}$ each represents a group which may function as a coupler having a coupling split-off group at the position (), after the group of formula (B-2) or (B-3) has cleaved from the mother skeleton at the position (*). d represents an integer of from 0 to 4. When d is a plural number, the $(R_{72})$'s may be the same or different. Where plural $(R_{72})$'s are present, they are bonded to each other to form a cyclic structure (for example, a benzene ring). Examples of $R_{72}$ include an acylamino group, an alkyl group and a halogen atom; examples of $R_{74}$ are an acylamino group, an alkyl group, an anilino group, an amino group and an alkoxy group; and examples of $R_{73}$ are a phenyl group and an alkyl group.

Specific examples of groups of formulae (B-2) and (B-3) are described below.

(B-4)

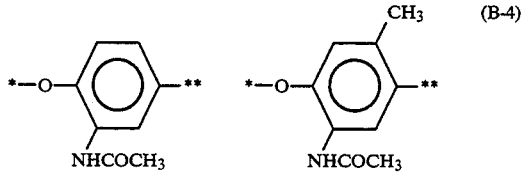

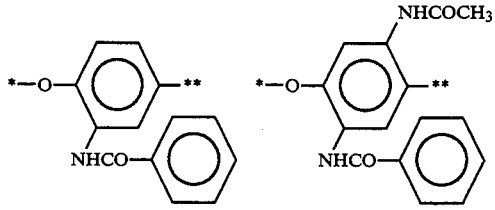

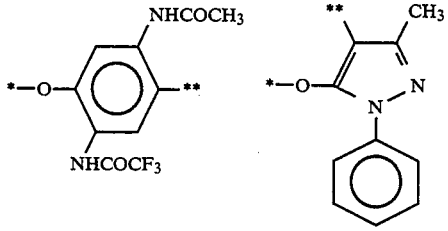

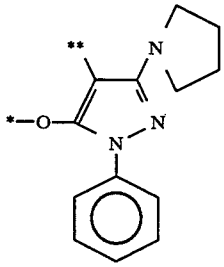

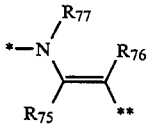

where the symbols (*) and () have the same meaning as in formula (B-1); and $R_{75}$, $R_{76}$ and $R_{77}$ each represent a substituent, and $R_{77}$ and $R_{76}$ may be bonded to each other to form a nitrogen-containing heterocyclic ring, or R77 and R75 may be bonded to each other to form a nitrogen-containing heterocyclic ring. The group of formula (B-4) is capable of forming a coupler having a coupling split-off group at the position (), after cleavage from the mother skeleton via the position (*).

Specific examples of groups of formula (B-4) are described below.

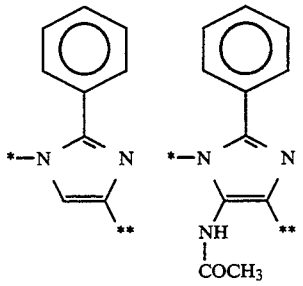

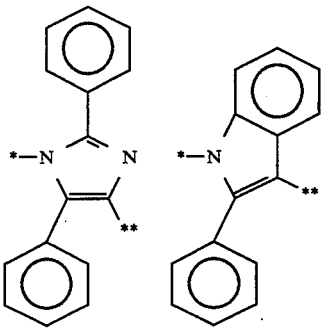

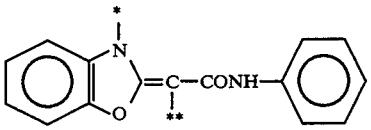

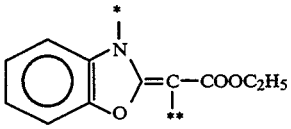

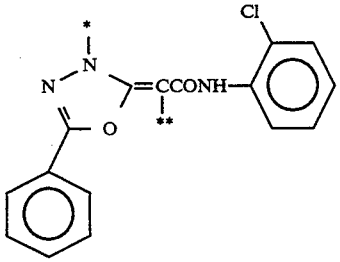

In formula (X-1), DI represents, for example, a tetrazolylthio group, a thiadiazolylthio group, an oxadiazolylthio group, a triazolylthio group, a benzimidazolylthio group, a benzothiazolylthio group, a tetrazolylseleno group, a benzoxazolylthio group, a benzotriazolyl group, a triazolyl group, or a benzimidazolyl group. Examples of these DI groups are described, for example, in U.S. Pat. Nos. 3,227,554, 3,384,657, 3,615,506, 3,617,291, 3,733,201, 3,933,500, 3,958,993, 3,961,959, 4,149,886, 4,259,437, 4,095,984, 4,477,563 and 4,782,012 and British Patent 1,450,479.

Specific examples of the group DI are described below, in which the symbol (*) indicates the position which is bonded to the left side of the group DI in formula (X-1 ).

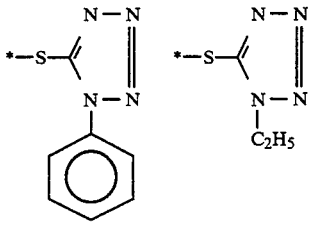

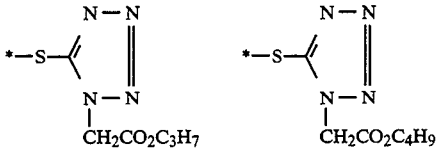

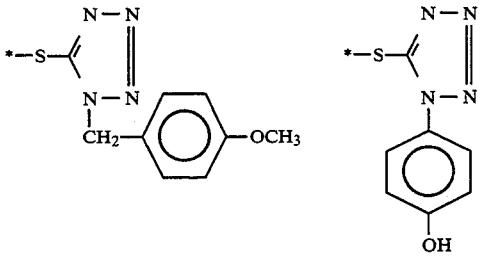

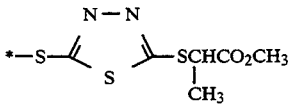

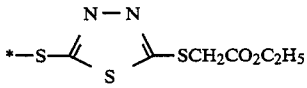

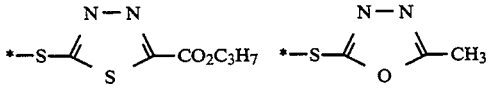

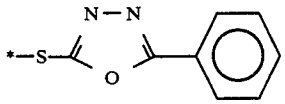

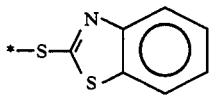

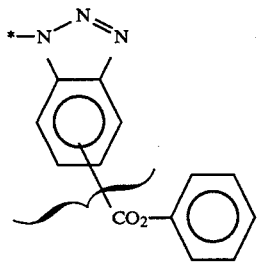

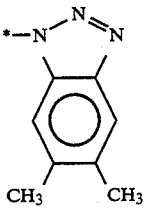

-continued

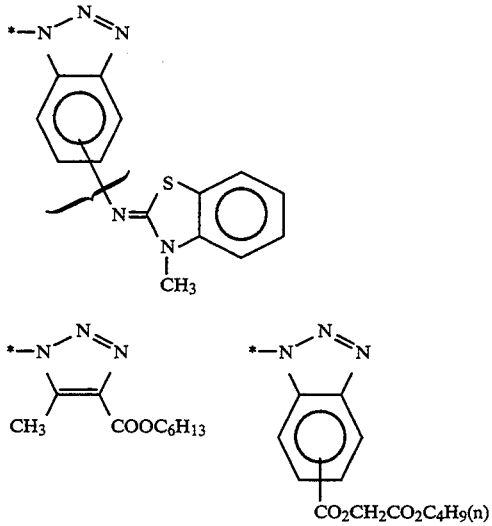

Of the groups of formula (X-1), especially preferred groups are those of the following formulae (X-2), (X-3) and (X-4).

$$-(L_1)-(B)-DI \quad (X\text{-}2)$$

$$-(L_2)-DI \quad (X\text{-}3)$$

$$-DI \quad (X\text{-}4)$$

In these formulae, $L_1$, $L_2$, B and DI have the same meaning as in formula (X-1).

In the compounds of formula (I), when X is a group which splits off from the formula via an oxygen atom, then R is preferably a hydrogen atom, an alkyl group or an aryl group, in view of the coupling reaction speed of the compounds with an oxidation product of a developing agent. In them, when X is a group which splits off from the formula via the group of formula (B-1), then it is especially desired that the split-off group has a substituent with a Hammett's $\sigma_p$ value of 0.3 or more, in view of the storage stability of the compounds in a photographic material.

In the compounds of formula (I), when X is a group which splits off from the formula via a nitrogen atom or a sulfur atom, then R is preferably an alkoxy group or an aryloxy group. In this case, in addition, it is especially desired that the azole ring moiety Z be unsubstituted or contain an alkyl group, an aryl group or a heterocyclic group as a substituent, in view of the storage stability of the compounds in a photographic material.

Of the compounds of formulae (P-1), (P-2), (P-3) and (P-4), those of formulae (P-1), (P-2) and (P-3) are preferred in view of the color hue of the magenta dyes to be formed therefrom. More preferred are those of formulae (P-2) and (P-3).

In formula (t), the substituent R or the substituent, if any, on the azole ring moiety Z may be a divalent group resulting in dimers or higher polymers where the respective moieties of formula (I) are bonded to each other via the divalent group.

Where the compounds of formula (I) are in the form of polymers, typical examples are homopolymers or copolymers composed of addition-polymerizable ethylenically unsaturated compounds having a residue of the compound of formula (I) (coloring monomers). In this case, the polymers contain repeating units of the following formula (II) and are represented by the same formula (II). The polymers may contain one or more different kinds of coloring repeating units therein, and they may also be copolymers containing one or more different kinds of non-coloring ethylenic monomers therein.

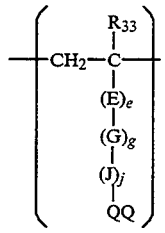

(II)

where $R_{33}$ represents a hydrogen atom, an alkyl group having from 1 to 4 carbon atoms, or a chlorine atom;

E represents —CONH—, —COO—, or a substituted or unsubstituted phenylene group;

G represents a substituted or unsubstituted alkylene, phenylene or aralkylene group;

J represents —CONH—, —NHCONH—, —NHCOO—, —NHCO—, —OCONH—, —NH—, —COP—, —OCO—, —CO—, —O—, —$SO_2$—, —$NHSO_2$—, or —$SO_2NH$—;

e, g and j each represent 0 or 1; and

QQ represents a residue of a compound of formula (I) derived by removing a hydrogen atom from the compound.

Preferred polymers are copolymers composed of compound monomers producing compound units of formula (II) and the following non-coloring ethylenic monomers.

Suitable non-coloring ethylenic monomers which do not couple with oxidation products of aromatic primary amine developer are acrylic acid, α-chloroacrylic acid, α-alacrylic acids (e.g., methacrylic acid), and esters and amides derived from these acrylic acids (e.g., acrylamide, methacrylamide, n-butylacrylamide, t-butylacrylamide, diacetonacrylamide, methylene-bisacrylamide, methyl acrylate ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, β-hydroxy methacrylate), vinyl esters (e.g., vinyl acetate, vinyl propionate, vinyl laurate), acrylonitrile, methacrylonitrile, aromatic vinyl compounds (e.g., styrene and derivatives thereof, such as vinyltoluene, divinylbenzene, vinylacetophenone, sulfostyrene), itaconic acid, citraconic acid, crotonic acid, vinylidene chloride, vinyl alkyl ethers (e.g., vinyl ethyl ether), maleates, N-vinyl-2-pyrrolidone, N-vinylpyridine, and 2- and 4-vinylpyridine.

Especially preferred are acrylates, methacrylates and maleates. In preparing these copolymers, one or more different kinds of the above-described non-coloring ethylenic monomers can be employed. For instance, a combination of methyl acrylate and butyl acrylate, a combination of butyl acrylate and styrene, a combination of butyl methacrylate and methacrylic acid, and a combination of methyl acrylate and diacetoneacrylamide can be employed.

As is well known to one skilled in the polymer coupler art, copolymers of containing the repeating units of the above-described formula (II) can be prepared by selecting appropriate non-coloring ethylenic monomers to be copolymerized with ethylenic monomers containing a dye-forming residue derived from the compound of formula (I) of the present invention in such a way that the physical properties and/or chemical properties, such as solubility, compatibility with binders (e.g., gelatin) used as photographic colloid compositions, flexibility and the heat stability, of the copolymers formed may be advantageously influenced by the non-coloring ethylenic monomers which are selected.

The polymer compounds to be used in the present invention (oleophilic polymer compounds obtained by polymerization of vinyl monomers providing the compound unit of the above-described formula (II)) may be dissolved in an organic solvent and the resulting solution may be dispersed, as a latex thereof, in an aqueous gelatin solution by emulsification; or alternatively, the polymer compounds may be formed by direct emulsion polymerization.

The method of dispersing an oleophilic polymer compound, as a latex thereof, in an aqueous gelatin solution by emulsification is disclosed in U.S. Pat. No. 3,451,820; and the latter direct emulsion polymerization method is disclosed in U.S. Pat. Nos. 4,080,211 and 3,370,952.

Specific examples of compounds of formula (I) which can be used in the present invention are described below, but the present invention is not to be construed as being limited to these compounds.

(1)

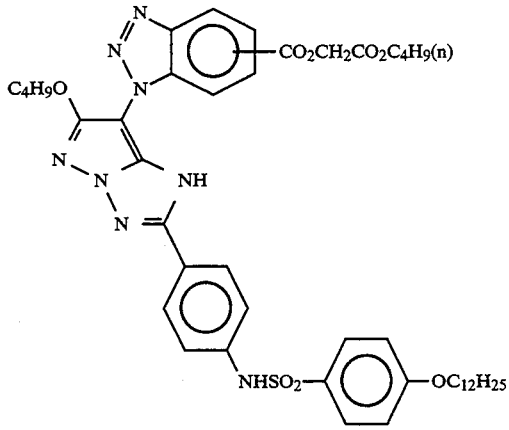

(2)

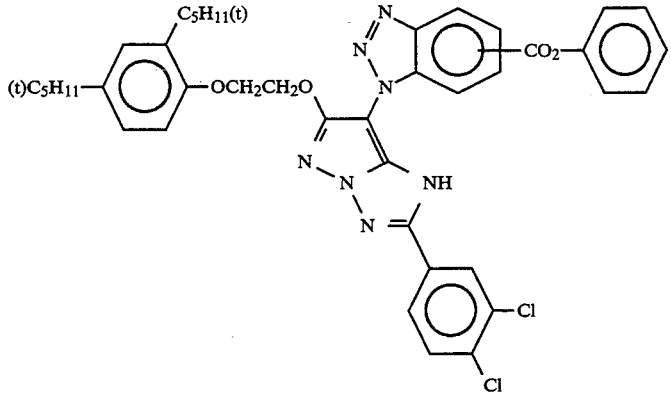

(3)

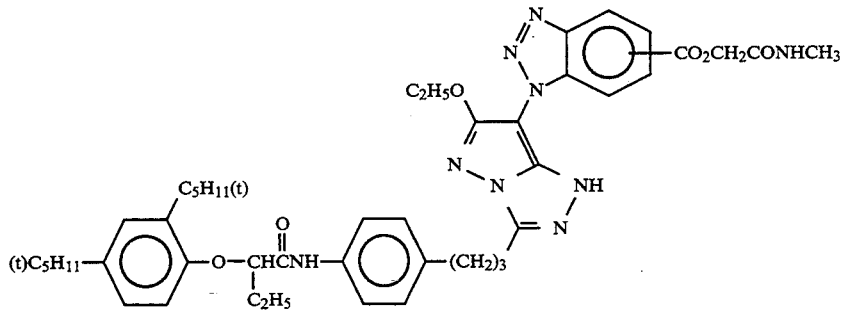

-continued
(4)
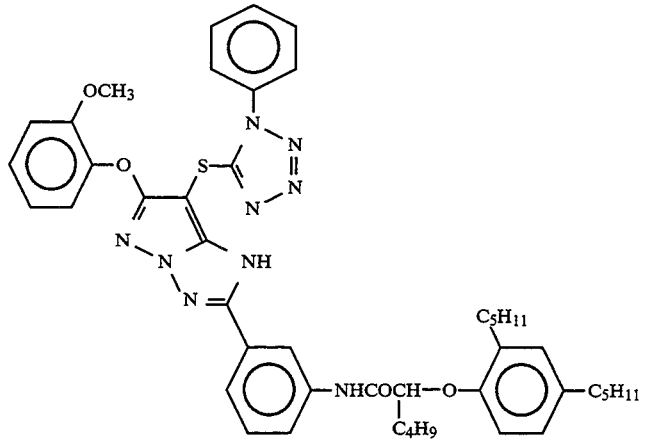
(5)
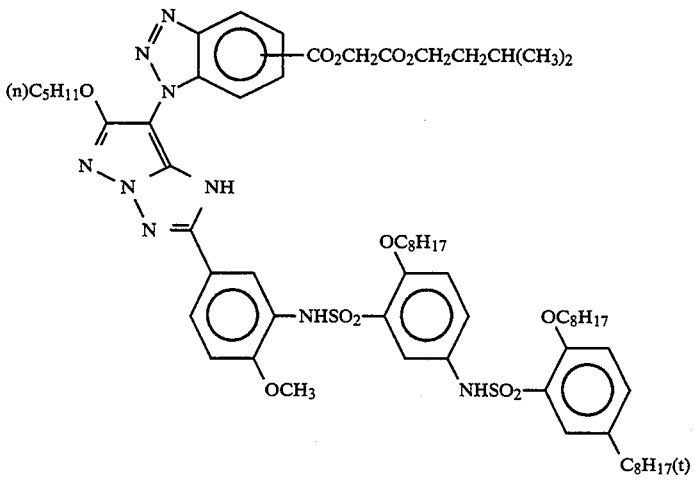
(6)
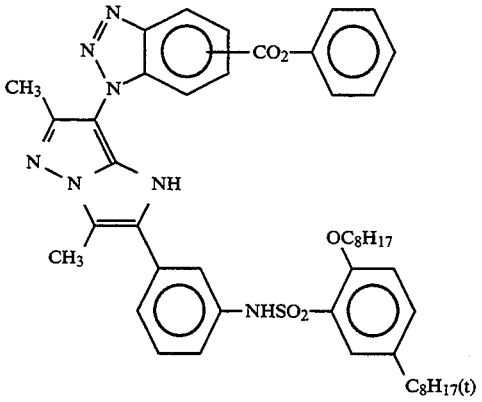
(7)
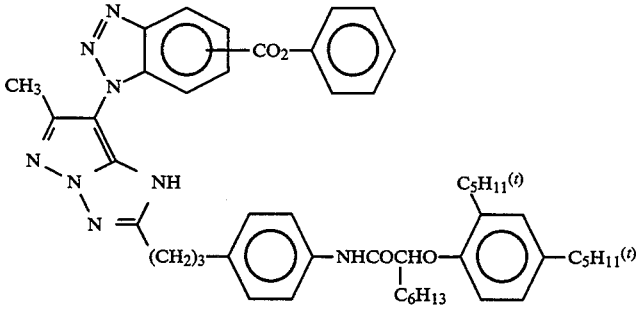

-continued
(8)
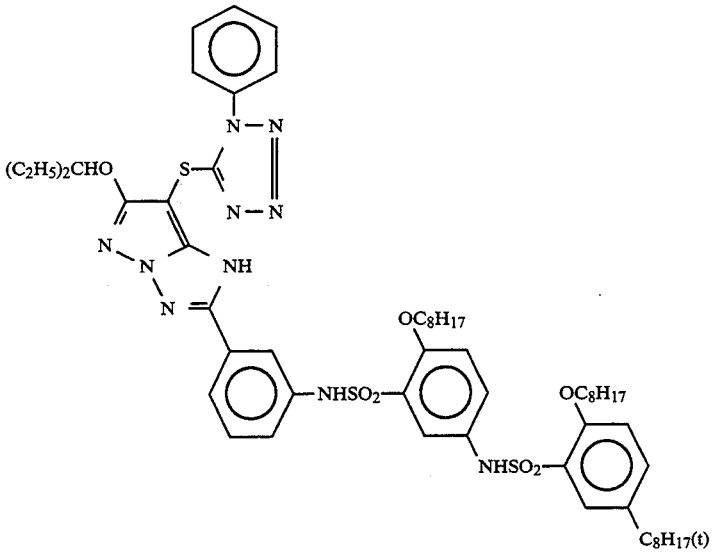
(9)
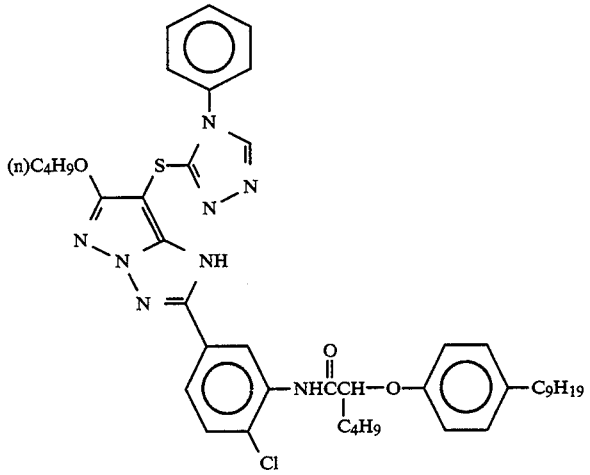
(10)
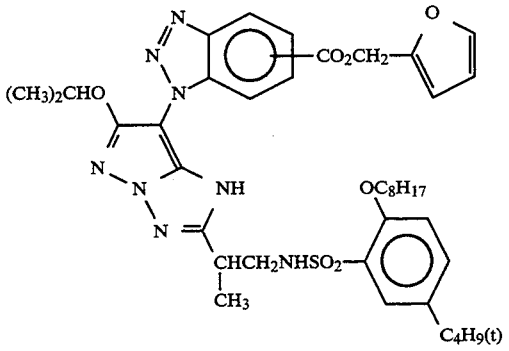

-continued
(11)
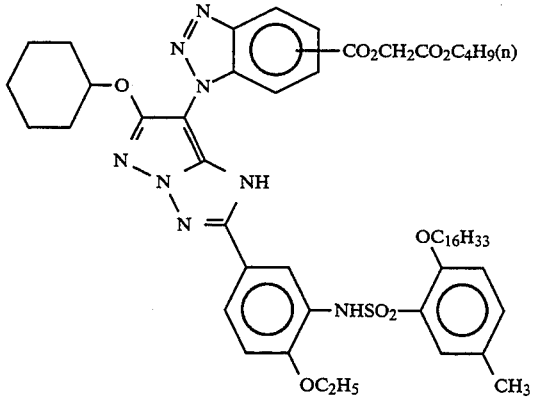
(12)
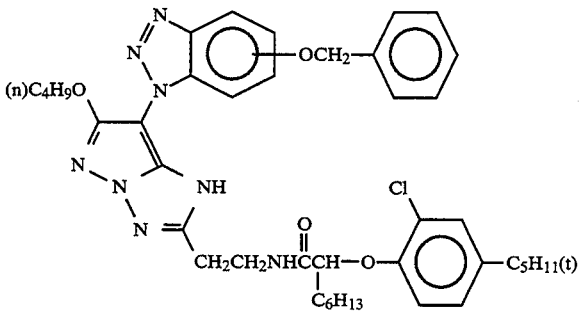
(13)
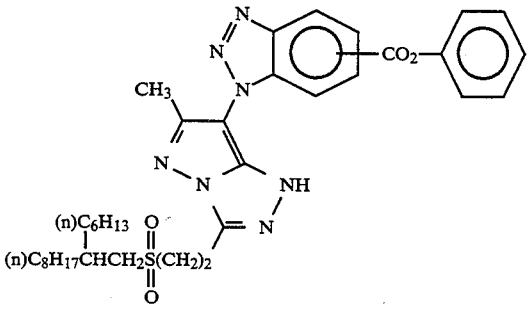
(14)
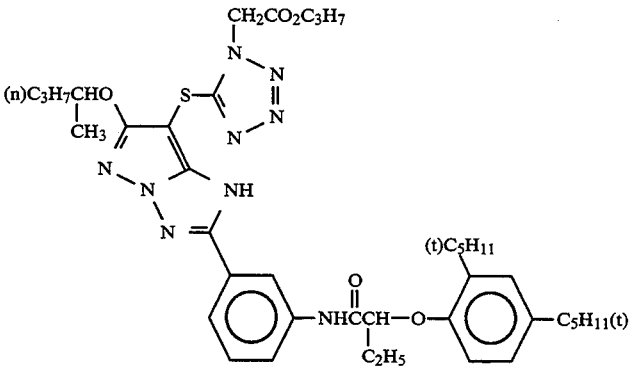

-continued
(15)
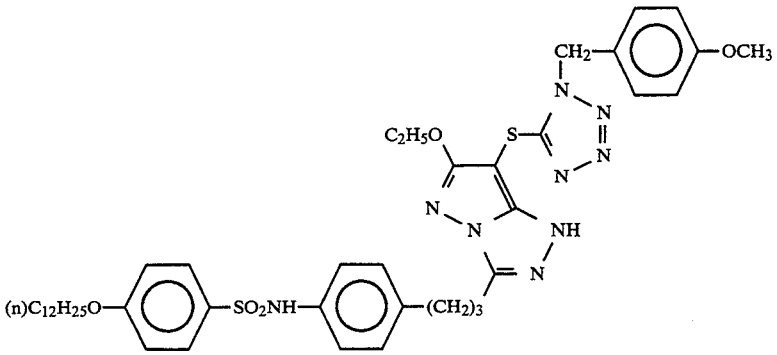
(16)
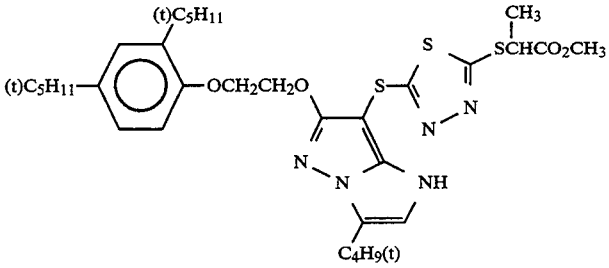
(17)
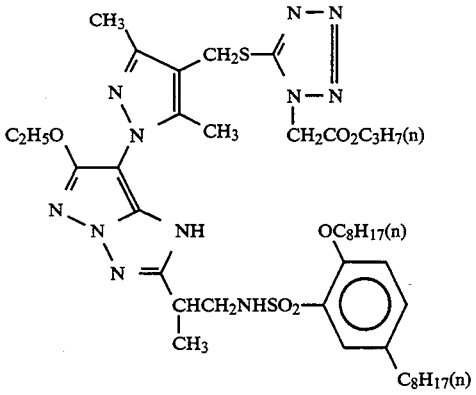
(18)
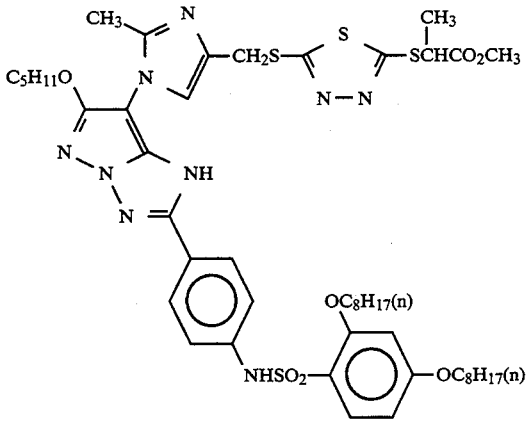

-continued
(19)
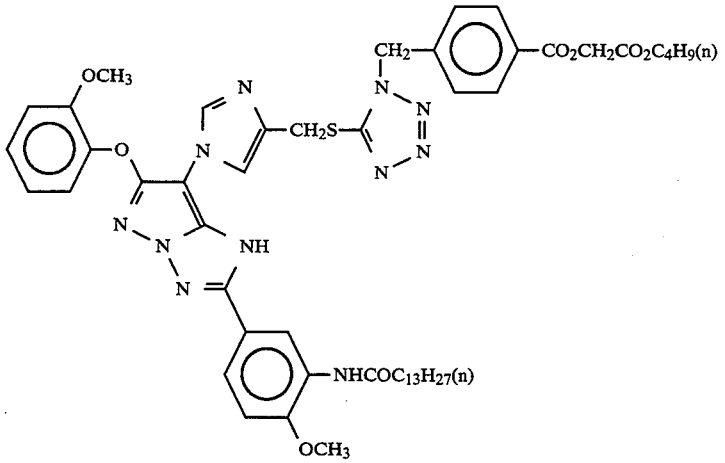
(20)
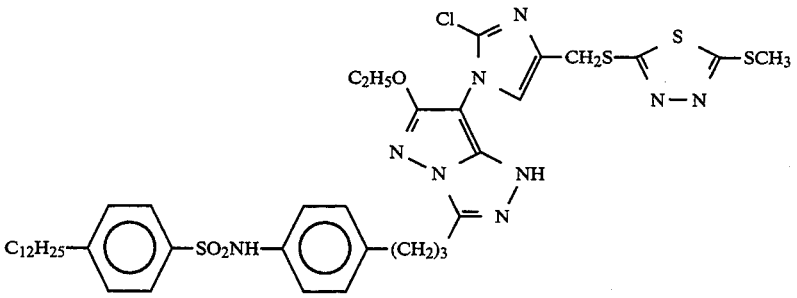
(21)
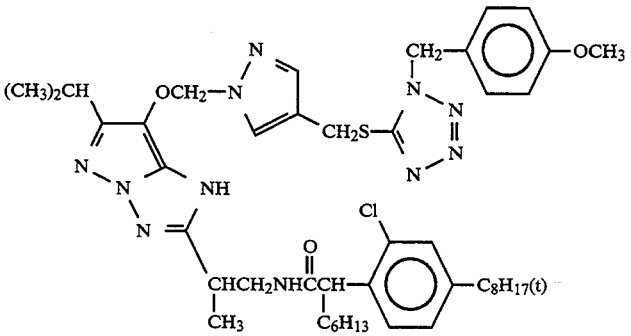
(22)
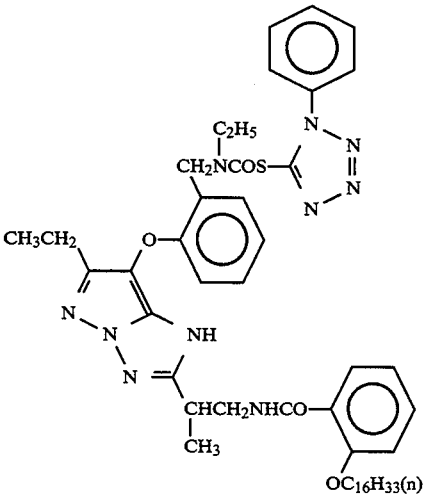

-continued
(23)
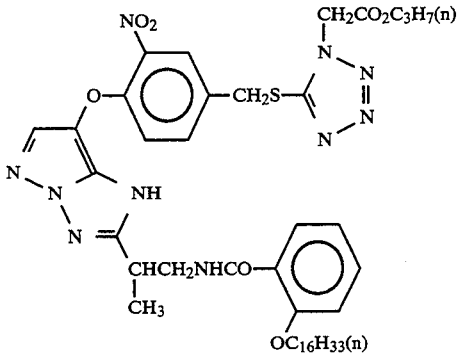
(24)
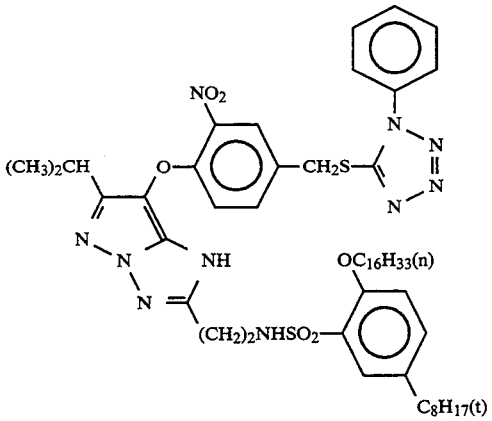
(25)
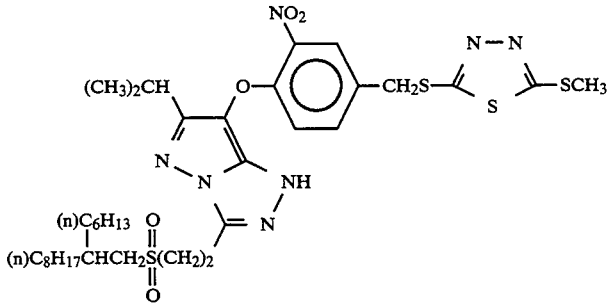
(26)
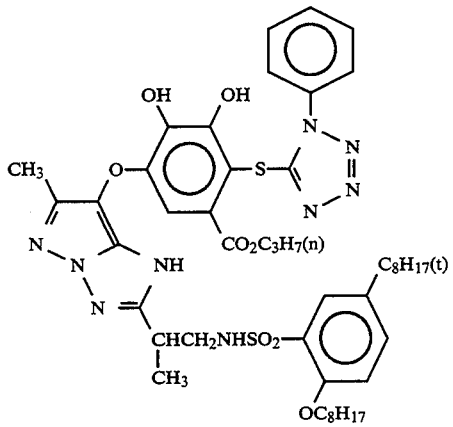

-continued
(27)
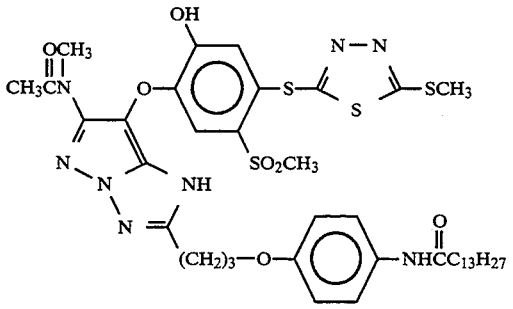
(28)
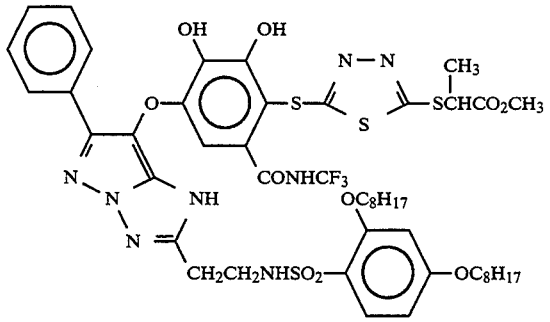
(29)
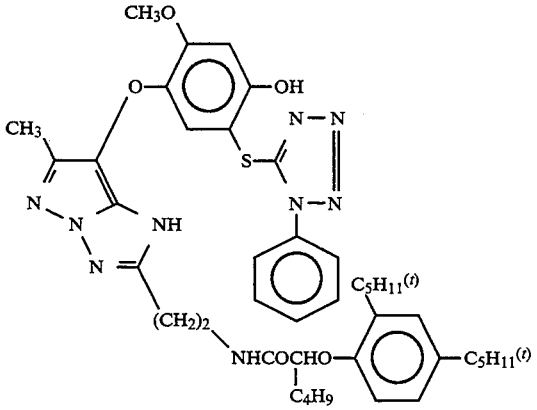
(30)
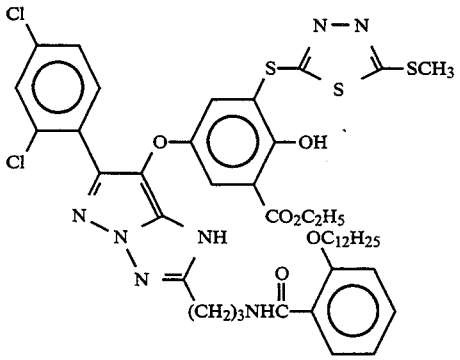

-continued
(31)
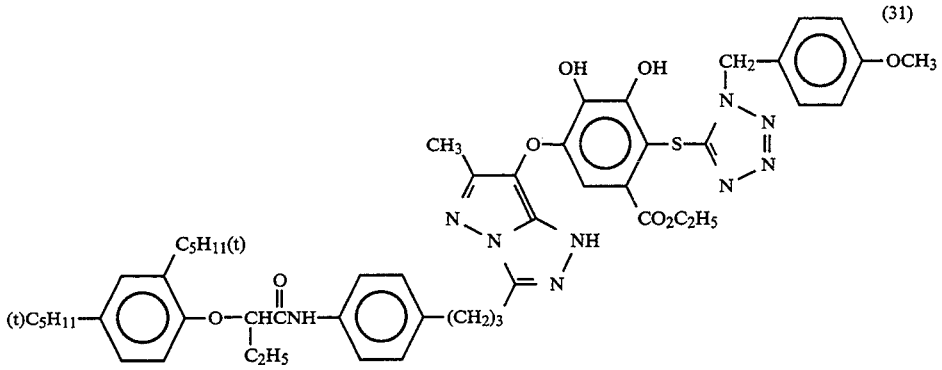
(32)
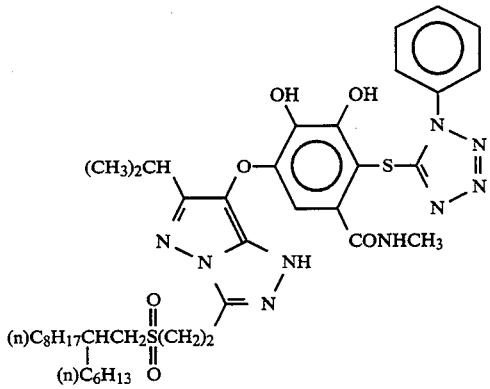
(33)
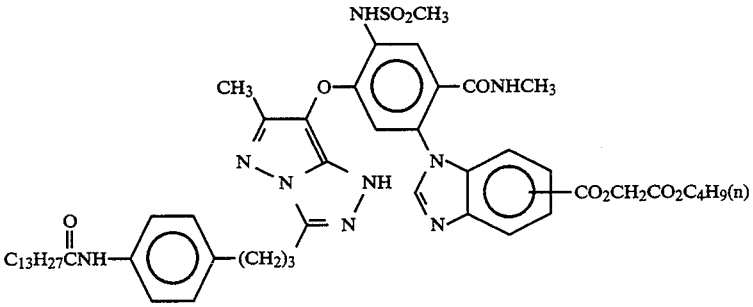
(34)
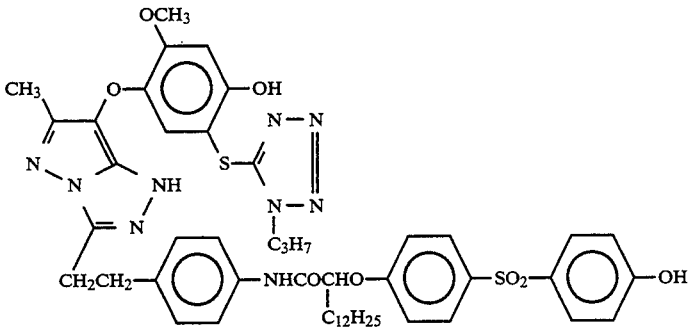

-continued
(35)
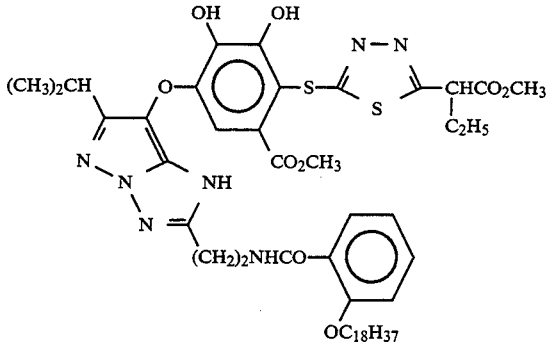
(36)
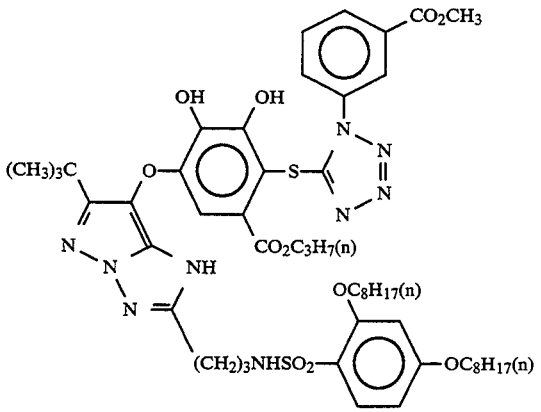
(37)
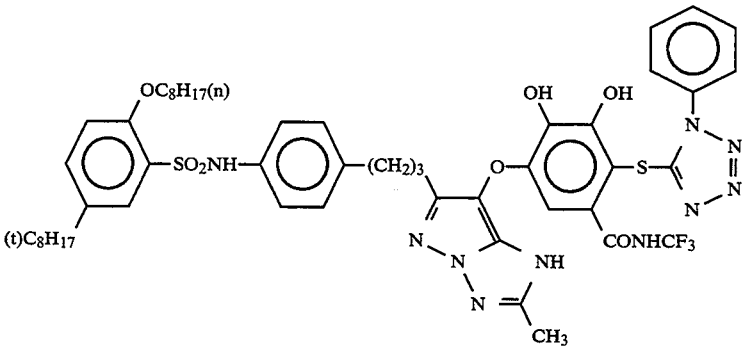
(38)
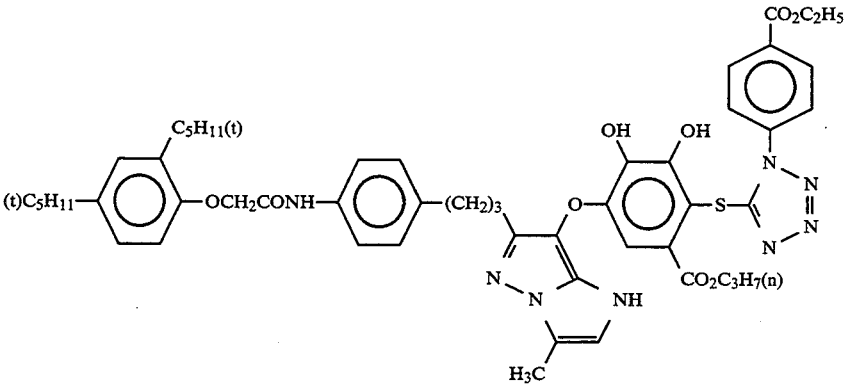

-continued
(39)
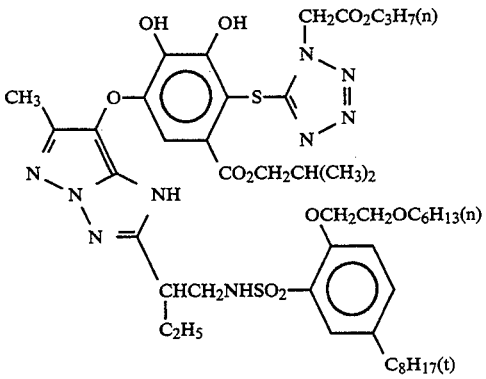
(40)
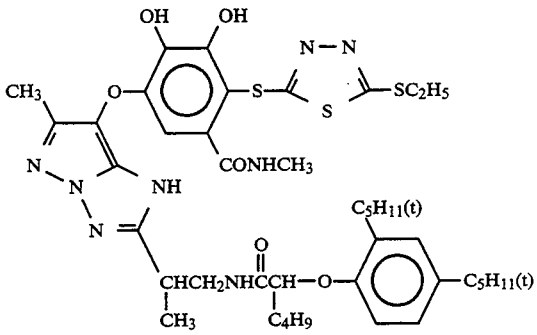
(41)
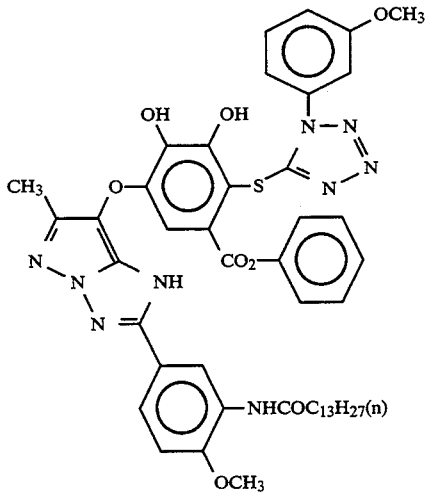
(42)
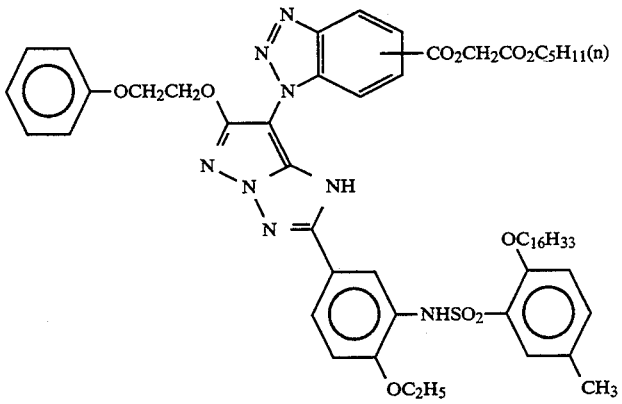

-continued
(43)
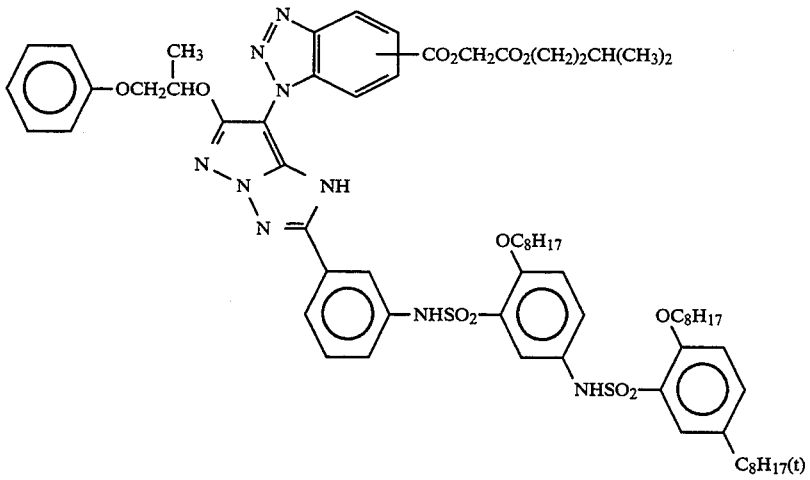
(44)
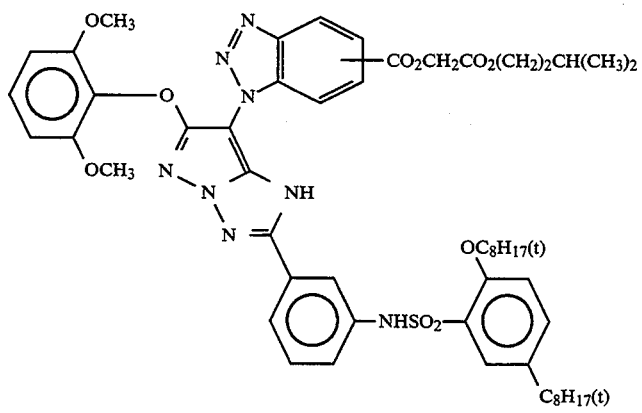
(45)
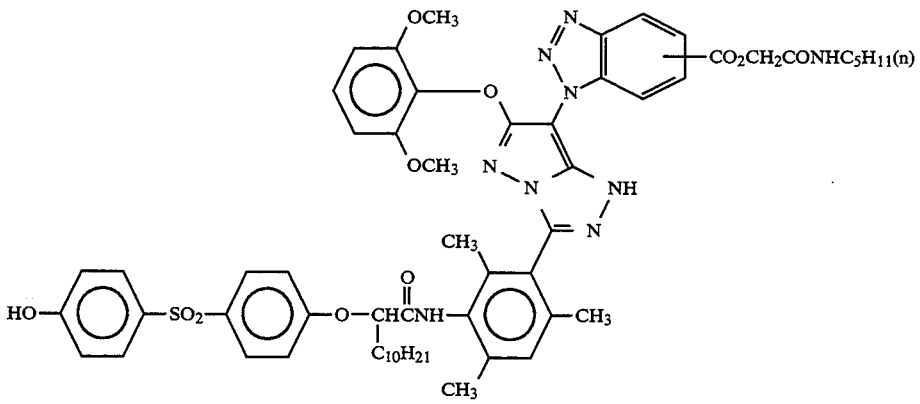

-continued (46)

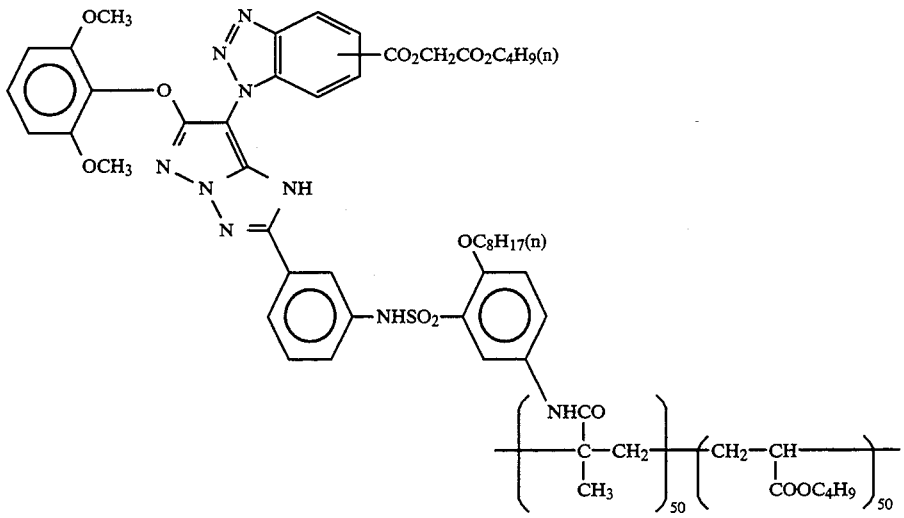

(47)

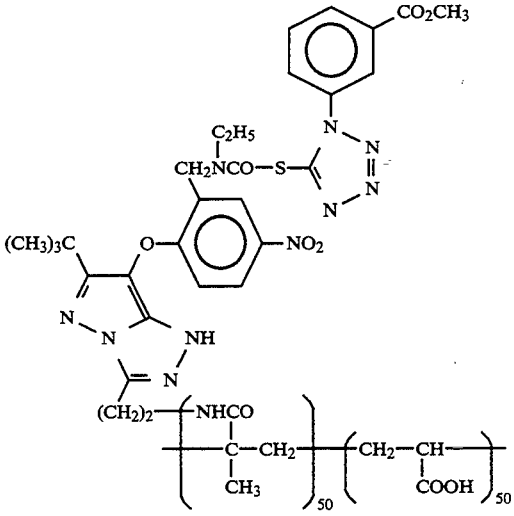

The compounds of formula (I) can be prepared in accordance with the methods described in U.S. Pat. Nos. 4,500,630, 4,540,654 and 4,705,863, JP-A-61-65245, JP-A-62-209457 and JP-A-62-249155, U.S. Pat. No. 3,725,067, JP-A-60-33552, JP-A-61-28947, JP-A-63-284159 and JP-A-2-59584, and U.S. Pat. No. 4,659,652.

The compound of formula (I) can be added to any layer of the photographic material of the present invention. Preferably, it is added to a green-sensitive emulsion layer and/or the adjacent layer(s) or interlayer(s); more preferably, it is added to a green-sensitive emulsion layer and/or an interlayer donor layer described hereinafter. One or more compounds of formula (I) may be added to the layer(s), alone or as a combination thereof. In addition, a combination of compound(s) of formula (I) of the present invention and compounds other than those of formula (I), which may react with one or two molecules of an oxidation product of a developing agent to release a development inhibitor or a precursor thereof may also be employed in the photographic material of the present invention.

High boiling point organic solvents usable in the present invention are those having a boiling point of 175° C. or higher at normal pressure (760 mmHg).

Examples of suitable high boiling point organic solvents usable to disperse a compound of formula (I) in the solvent using an oil-in-water dispersion are phosphates (e.g., triphenyl phosphate, tricresyl phosphate, octyldiphenyl phosphate, tri-2-ethylhexyl phosphate, tri-n-hexyl phosphate, tri-iso-nonyl phosphate, tricyclohexyl phosphate, tributoxyethyl phosphate, tri-2-chloroethyl phosphate), benzoates (e.g., 2-ethylhexyl benzoate, 2-ethylhexyl 2,4-dichlorobenzoate), fatty acid esters (e.g., di-2-ethylhexyl succinate, 2-hexyldecyl tetradecanoate, tributyl citrate), amides (e.g., N,N-diethyldodecanamide, N-tetradecylpyrrolidone), dialkylanilines (e.g., 2-butoxy-5-tert-octyl-N,N-dibutylaniline), chlorinated paraffins (e.g., paraffins having a chlorine content of from 10% to 80%), phenols (e.g., 2,5-di-tert-amylphenol, 2,5-di-tert-hexyl-4-methoxyphenol, 2-ethylhexyl p-hydroxybenzoate), and phthalates (e.g., dibutyl phthalate, dicyclohexyl phthalate, diheptyl phthalate, di-2-ethylhexyl phthalate, didodecyl phthalate). Phosphates and phthalates are especially preferred.

The amount of the high boiling point organic solvent to be used in preparing the photographic material of the present invention is dependent on the total weight of the compounds to be dissolved in the solvent to be present in one layer. For instance, the amount is at most 2.0 g per 1.0 g of the compounds. If the amount of the high boiling point organic solvent is more than this, the photographic material formed has poor color image storability. A preferred range of the amount of the solvent is 1.6 g or less, more preferably 1.1 g or less, per 1.0 g of the compounds.

The total weight of the compounds (to be dissolved in a high boiling point organic solvent) as referred to herein means the total of the weights of all compounds which are present in a silver halide emulsion layer containing at lease one compound of formula (I) and which react with one molecule or two molecules of an oxidation product of a developing agent to release a development inhibitor or a precursor thereof.

The "particular spectral sensitivity range" as referred to herein means the wavelength range between the long wave in the long wavelength side and that in the short wavelength side, corresponding to a sensitivity of 1/10 of the maximum color sensitivity range of a spectral sensitivity spectral curve.

Regarding the weight-averaged wavelength of spectral sensitivity distribution as referred to herein, the disclosure of U.S. Pat. No. 4,705,744 may be referred to. For instance, the weight-averaged wavelength $\lambda_G$ for GL may be represented by the following formula.

$$\lambda_G = \frac{\int_{470}^{600} \lambda \cdot S_G(\lambda)d\lambda}{\int_{470}^{600} S_G(\lambda)d\lambda}$$

where $S_G(\bar{\lambda})$ indicates the spectral sensitivity distribution curve of GL, and $S_G(\bar{\lambda})$ at a particular $\bar{\lambda}$ can be obtained from the point (a) in FIG. 1 as a relative value.

In the same manner, $\bar{\lambda}_R$ and $\bar{\lambda}_B$ can be represented by the following formulae.

$$\lambda_R = \frac{\int_{540}^{700} \lambda \cdot S_R(\lambda)d\lambda}{\int_{540}^{700} S_R(\lambda)d\lambda}$$

$$\lambda_B = \frac{\int_{400}^{520} \lambda \cdot S_B(\lambda)d\lambda}{\int_{400}^{520} S_B(\lambda)d\lambda}$$

The weight-averaged wavelength($\bar{\lambda}_{-R}$) of the wavelength distribution of the degree of the interlayer effect which a red-sensitive silver halide emulsion layer receives from any other layer in the range of from 500 nm to 600 nm is determined as follows:

(1) First, a photographic material is uniformly exposed through a red filter which transmits light having a specific wavelength or longer in order that it may sensitize only the red-sensitive layer to form a cyan color with a light having a wavelength of 600 nm or more but does not sensitize any other layer, or through an interference filter capable of transmitting only light having a specific wavelength; whereby the red'sensitive layer forming a cyan color is uniformly fogged to a specific level.

Figure 2:
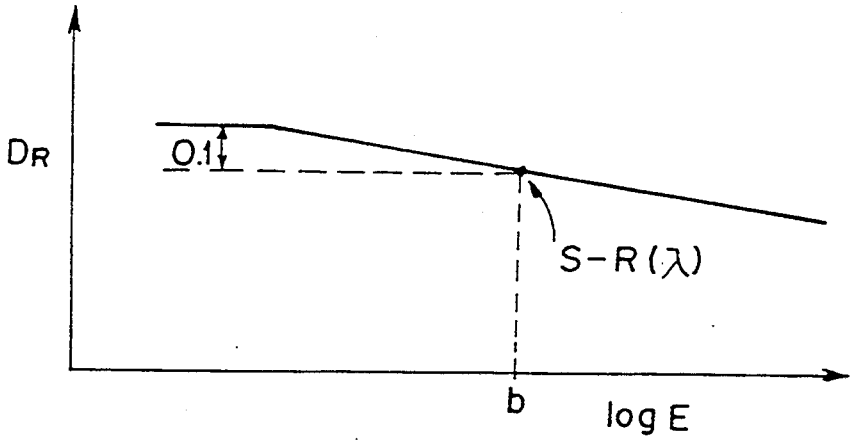
FIG. 2 shows a characteristic curve of a reversal image on a red-sensitive layer at $\bar{\lambda}$ obtained after receipe of an interlayer effect from a green-sensitive layer.

(2) Next, the material is spectrally exposed whereby an interlayer effect for inhibition of development is imparted from the blue-sensitive layer or the green-sensitive layer to the above-described fogged emulsion to produce a reversal image therein. (see FIG. 2)

(3) From the reversal image, the spectral sensitivity distribution ($S_{-R}(\bar{\lambda})$) as a reversal photographic material is obtained. ($S_{-R}(\bar{\lambda})$ for a particular $\bar{\lambda}$ can be obtained relatively from the point (b) in FIG. 2.)

(4) The weight-averaged wavelength ($\bar{\lambda}_{-R}$) of the interlayer effect is calculated by the following formula:

$$\lambda_{-R} = \frac{\int_{500\text{ nm}}^{600\text{ nm}} \lambda \cdot S_{-R}(\bar{\lambda})d\lambda}{\int_{500\text{ nm}}^{600\text{ nm}} S_{-R}(\lambda)d\lambda}$$

Accordingly, the weight-averaged wavelength of the negative interlayer effect to RL may be defined as $\bar{\lambda}_{-R}$; and the spectral sensitivity distribution of the negative interlayer effect to RL may be defined as $S_{-R}(\bar{\lambda})$. Other terms are analogously defined in accordance with the above.

A first object of the present invention is to achieve a natural color reproducibility in a color photographic material appropriate to the human eye. In this reference is made to the disclosure in *Color Science Handbook*, Chap. 10 (edited by Nippon Color Society, 5th Ed., published by Tokyo University Publishing Association, 1985), from which a Wright's curve indicating the human color spectral chromaticity values for the three colors, red, green and blue, is known. Color reproducibility of photographic materials is described in *Principles of Color Photography* (written by R. M. Evans, et al., published by John Wiley & Sons, 1953), Chap. 18. As is shown by a visual color-matching relative spectral sensitivity distribution using a chromaticity system for reproduction of yellow, magenta and cyan, it is understood that the effect of imparting a negative sensitivity to each of the blue-sensitive, green-sensitive and red-sensitive distributions is necessary.

The present inventors investigated various means for imparting such a negative sensitivity to the respective color-sensitive distributions and, as a result, have found that, for the purpose of obtaining an improved color reproducibility to achieve a visually natural color image, the following requirements for the appropriate negative sensitivities or negative interlayer effects are essential.

(a) The weight-averaged wavelength of the negative interlayer effect relative to RL ($\bar{\lambda}_{-R}$) falls between about 490 nm and about 560 nm.

(b) The weight-averaged wavelength of the negative interlayer effect relative to GL ($\bar{\lambda}_{-G}$) falls between about 400 nm and about 500 nm and/or between about 570 nm and about 670 nm.

(c) The weight-averaged wavelength of the negative interlayer effect relative to BL ($\bar{\lambda}_{-B}$) falls between about 520 nm and about 590 nm.

In order to impart the above-described negative interlayer effect in a specific wavelength range to the respective sensitive layers RL, GL and BL, an interlayer effect donor layer containing silver halide grains which are specifically spectrally sensitized may be provided separately, or alternatively, the respective sensitive layers themselves may provide such a function. More preferably, separate interlayer effect donor layers are provided for the respective sensitive layers (RL, GL and BL). The interlayer effect donor layer as referred to herein can be said to be a layer which has the above-mentioned determined spectral sensitivity distribution and which has the function of imparting a negative interlayer effect to a specific sensitive layer.

The present inventors extensively investigated color photographic materials with a high color masking effect and an interlayer effect using DIR compounds, for the purpose of obtaining an adequate direction for planning and tailoring a color photographic material capable of faithfully achieving color reproduction. As a result, it has been found that the faithfulness of color reproducibility of a color photographic material may quantitatively be determined by measuring the reproduction of a spectral light combined with a white light in the material. In accordance with the method, spectral light as combined with a white light, or that is, spectral light having a lowered excitation purity (Pe) is used. The reasons are because when pure spectral light is used to expose to the photographic material so that only one of the blue-sensitive, green-sensitive and red-sensitive layers is sensitized with the light, then the influence of the interlayer effect could not be obtained; and because most picture-taking color photographic materials are frequently used for photographing objects of reflective substances having somewhat turbid and impure colors.

A method of measuring the faithfulness of color reproducibility of a color photographic material is described below.

Step (1):

An equivalent energy spectral light having a constant excitation purity, as established by CIE in 1931, is used to expose a color photographic material at regular intervals of 10 nm between 400 nm and 700 nm. In addition, the material is also exposed to a C light source as established in CIE.

Step (2):

Where the exposed material is a color reversal material, it is then directly developed. Where the exposed material is a color negative material, it is printed onto a color print material with a C light source, as established by CIE, in such a way that the previously exposed part may be finished as a gray and the printed material is then developed.

Step (3):

The chromaticity of the thus reproduced positive image is measured with a colorimeter SS Color Computer (manufactured by Suga Electric Co.) and is plotted on a CIE xy chromaticity diagram (1931).

Figure 3:
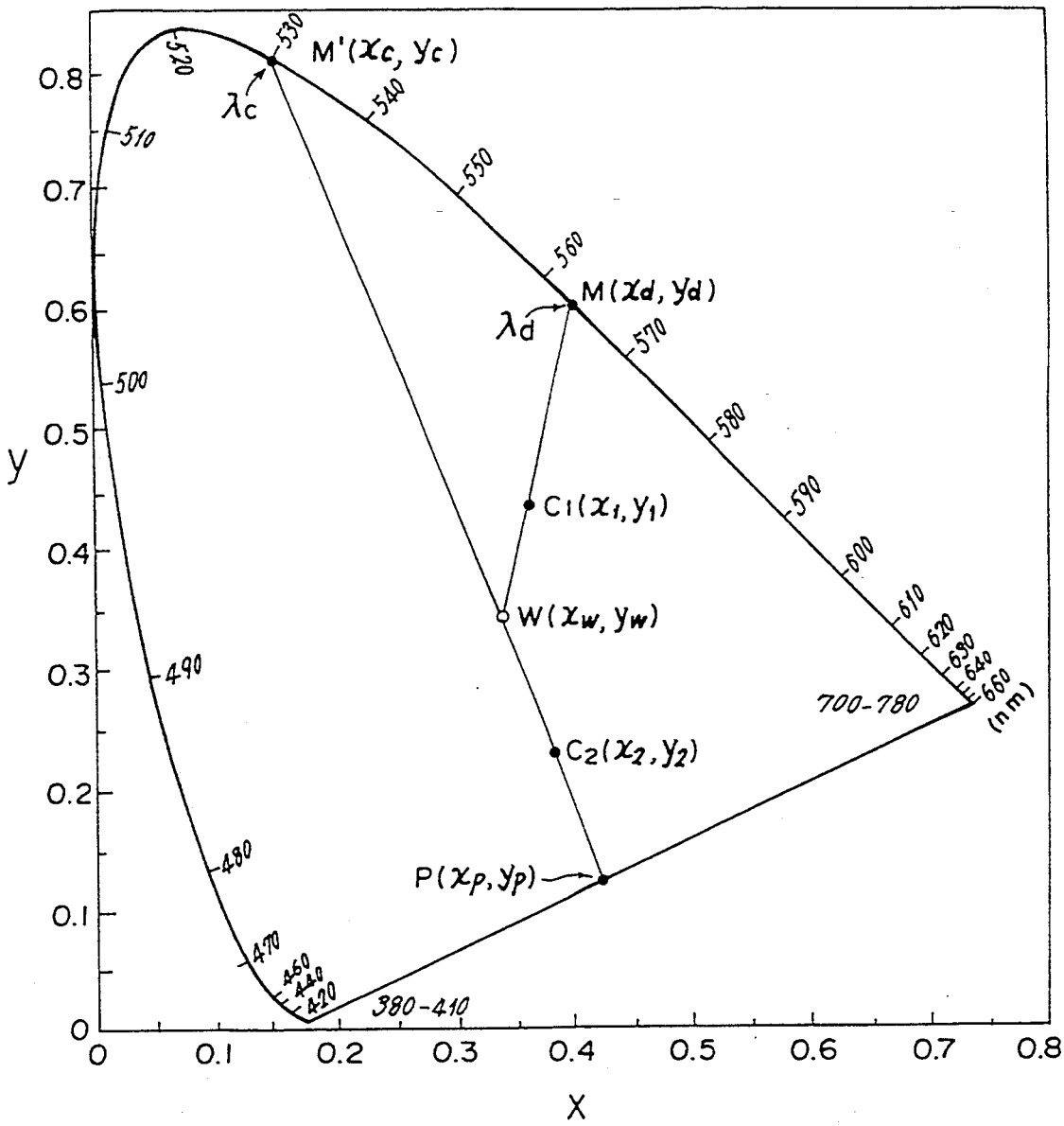
FIG. 3 is a graph showing a dominant wavelength of a positive image as reproduced on a chromaticity diagram.
Figure 4:
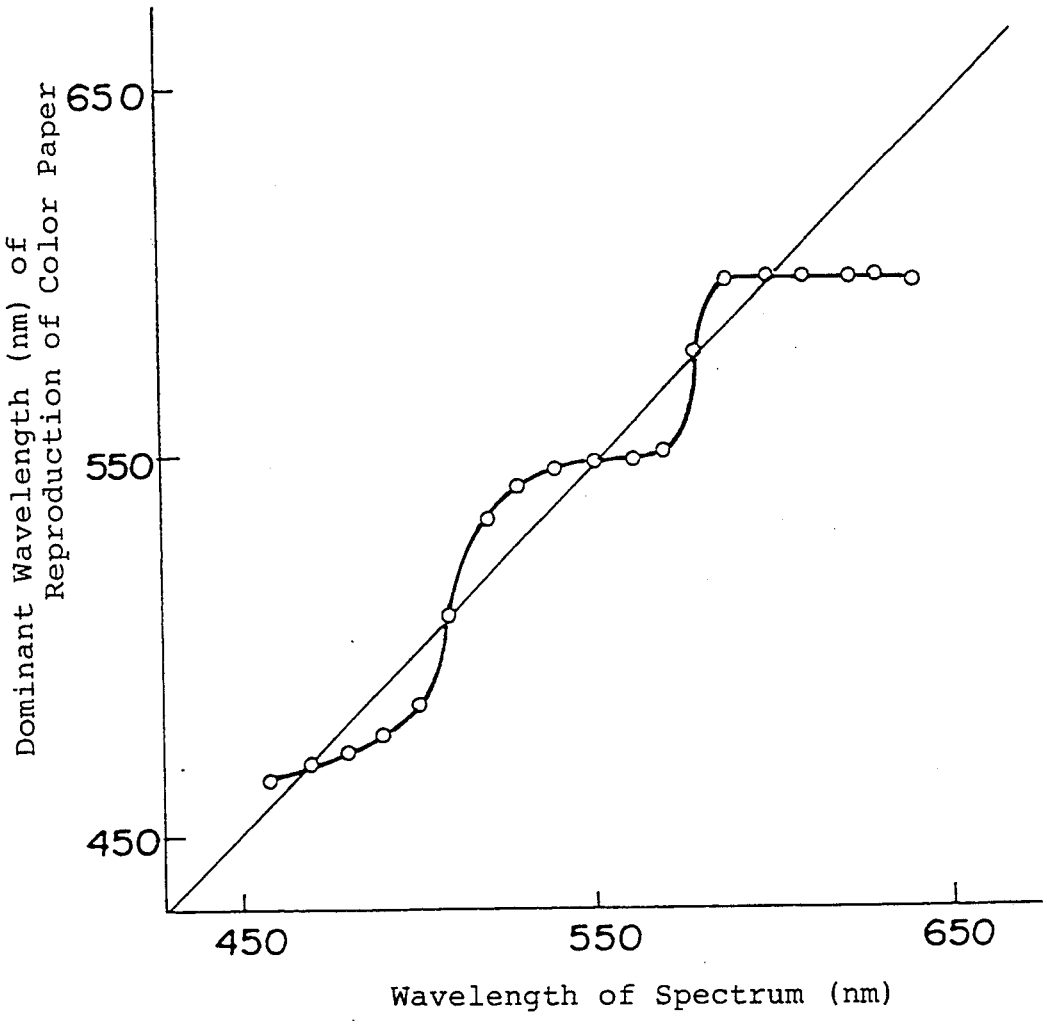
FIG. 4 is a graph showing the relationship between the wavelength of a spectral light used for exposure and the above-described dominant wavelength.

Step (4):

The dominant wavelength of the positive image reproduced by the figure on the chromaticity diagram is obtained, as shown in FIG. 3, and the relationship between the wavelength of the exposed spectral light and the thus obtained dominant wavelength is plotted as in FIG. 4.

A graph of the type shown in FIG. 4 is obtained after the above-described steps (1) to (4) are conducted. In the graph, where the wavelength of the spectral light used to expose the photographic material is more consistent with the dominant wavelength of the reproduced image, or that is, where the relationship therebetween is represented by a linear line, the color reproducibility of the photographic material is considered to be better.

As a result of earnest studies on the basis of the above-mentioned method, the present inventors have found that in order to obtain faithful color reproducibility to a spectral light in the entire visible range in a color photographic material with a large interlayer effect, the color photographic material must satisfy at least one of the above-described requirements (a), (b) and (c).

An interlayer effect donor layer is preferably provided in the color photographic material of the present invention in order that the material satisfies at least one of the requirements (a), (b) and (c). Conventional color sensitizing materials applicable to silver halides may be added to the interlayer effect donor layer whereby the above-described specific spectral sensitivity may be imparted to the respective sensitive layers of the color photographic material. In particular, in the present invention, examples of materials imparting such an interlayer effect are compounds capable of reacting with an oxidation product of a developing agent (formed in development) to release a development inhibitor or a precursor thereof from them. For instance, usable compounds are DIR (development inhibitor releasing) compounds, DIR-hydroquinones, compounds releasing DIR-hydroquinones or precursors thereof, and compounds reacting with an oxidation product of a developing agent to release such compounds.

In addition, colored couplers, and couplers releasing dyes having a specific spectral absorption characteristic may also be used as materials imparting a negative interlayer effect for anyone of the above-described requirements (a), (b) and (c). If desired in the present invention, spectral sensitivity distribution of the respective interlayer effect donor layers may be achieved with sensitizing dyes, or by a filter effect using dyes.

Examples of DIR compounds which can be added to the interlayer effect donor layers so as to achieve the above-described requirements (a), (b) and (c) in the photographic material of the present invention are compounds of the following formula (III) which can also be used in addition to the compounds of the present invention.

$$A-[(L_1)_a]-Z \qquad \text{(III)}$$

where

A represents a residue of a coupler component (including a residue of a colorless coupler or a hydroquinone residue);

Z represents a mother skeleton of a compound providing a development inhibiting activity (development inhibitor);

a represents 0 or 1; when a is 0, then Z is directly bonded to A, and when a is 1, then Z is bonded to A via a linking group $L_1$; and $L_1$ represents a linking group.

As the coupler component A in formula (III), coupler components which react with an oxidation product of a developing agent but do not form color dyes, as described in, for example, U.S. Pat. Nos. 4,052,213, 4,088,491, 3,632,345 and 3,958,993, and JP-A-51-64927 and JP-A-55-161237 are also preferred. Compounds of formula (III ) having a coupler component of this type may widely be used in the interlayer effect donor layers of the photographic material of the present invention.

Compounds of formula (III) are explained in detail below.

Examples of an yellow color image-forming coupler residue (an yellow coupler component ) for A in formula (III ) are preferably, for example, residues of pivaloylacetanilide couplers, benzoylacetanilide couplers, malondiester couplers, malondiamine couplers, dibenzoylmethane couplers, benzothiazolylacetamide couplers, malonester monoamide couplers, benzothiazolyl acetate couplers, benzoxazolylacetamide couplers, benzoxazolyl acetate couplers, benzimidazolylacetamide couplers and benzimidazolyl acetate couplers; coupler residues derived from heterocyclic-substituted acetamides or heterocyclic-substituted acetates described in U.S. Pat. No. 3,841,880; coupler residues derived from acylacetamides described in U.S. Pat. No. 3,770,446, British Patent 1,459,171, German Patent (OLS) No. 2,503,099, JP-A-50-139738 and Research Disclosure No. 15737; and heterocyclic coupler residues described in U.S. Pat. No. 4,046,574.

Examples of a magenta color image-forming coupler residue (a magenta coupler component) for A in formula (III) are preferably, for example, residues of 5-oxo-2-pyrazoline nucleus couplers, pyrazolo[1,5-a]benzimidazole nucleus couplers and cyanoacetophenone couplers.

Examples of a cyan color image-forming coupler residue (a cyan coupler component) for A in formula (III) are preferably, for example, residues of phenol nucleus couplers and $\alpha$-naphthol nucleus couplers.

The mother moiety of the development inhibitor Z in formula (III), preferably is a divalent nitrogen-containing heterocyclic group or a nitrogen-containing heterocyclic-thio group. Examples of a heterocyclic-thio group for the moiety include a tetrazolylthio group, a benzothiazolylthio group, a benzimidazolylthio group, a triazolylthio group and an imidazolylthio group.

In the present invention, a DIR compound of formula (III) where Z contains a substituent capable of hydrolyzing under alkaline conditions are preferred, since compounds released from such DIR compounds into the processing solution are advantageously converted into those which do not retard development. Such a hydrolyzing DIR compound may be bonded to the coupler component residue A in formula (III), directly (a=0) or via a timing group (a=1) therebetween.

The interlayer effect donor layer in the photographic material of the present invention preferably contains compounds of the above-described formulae (I) and (III). In order that the material satisfies the requirement (a) such that $\bar{\lambda}_R$ for RL falls between about 490 nm and about 560 nm, the interlayer effect donor layer for RL preferably contains a compound having a residue of a magenta-coloring coupler component which produces little cyan color. Especially preferably, the donor layer contains a compound of formula (I) in this case.

In order for the material to satisfy requirement (b) such that $\bar{\lambda}_G$ for GL falls between about 400 nm and about 500 nm and/or between about 570 nm and about 670 nm, the interlayer effect donor layer for GL preferably contains a compound with a residue of a yellow- or cyan-coloring coupler component which produces little magenta color. In order for the material to satisfy the requirement (c) such that $\bar{\lambda}_B$ for BL falls between about 520 nm and about 590 nm, the interlayer effect donor layer for BL preferably contains a compound with a residue of a magenta-coloring coupler component which produces little yellow color. More preferably, the donor layers each contains a compound of formula (I) of the invention.

In the present invention the possible range of $(\bar{\lambda}_G-\bar{\lambda}_R)$ is between −40 nm and 90 nm (−40 nm$\leqq\bar{\lambda}_G-\bar{\lambda}_R\leqq$90 nm), in view of the above-mentioned definitions of $\bar{\lambda}_G$ and $\bar{\lambda}_R$. The more preferred range for the purpose of improving the red saturation and various green differentiation is 5 nm$\leqq\bar{\lambda}_G-\bar{\lambda}_R\leqq$80 nm, especially preferably 20 nm$\leqq\bar{\lambda}_G-\bar{\lambda}_R\leqq$60 nm.

The position of the interlayer effect donor layer in the photographic material of the present invention is preferably on the side of the surface of the light-sensitive layer which receives the effect from the donor layer and near to the light-sensitive layer. For instance, it is preferred that the interlayer effect donor layer for RL is positioned on the side of the surface of RL, near to the support and adjacent the yellow filer layer. GL may be positioned between the donor layer and RL or nearer the support than RL. For instance, the interlayer effect donor layer to GL falling between 400 nm and 500 nm may be provided on the side of the surface of GL, or on the side of the surface of the yellow filter layer, or on or below BL, or as the BL layer itself. The donor layer to the same of falling between 570 nm and 670 nm preferably is positioned on the side nearer the support than the yellow filter layer formed on GL. The high-sensitivity RL layer itself may also function as the donor layer to GL. The donor layer to BL may be GL itself, or it may be positioned adjacent the yellow filter layer and nearer the support than the yellow filter layer. The RL layer itself may also function as the donor layer to BL.

The relationship of the position between the interlayer effect donor layer and the interlayer effect acceptor layer may be appropriately selected so that the activation speed and diffusability of the development inhibitor released from the DIR compound by reaction with an oxidation product of a developing agent during color development is controlled and the object of the present invention is attained thereby.

The photographic material of the present invention is not specifically limited, provided that it has at least one blue-sensitive silver halide emulsion layer, at least one green-sensitive silver halide emulsion layer and at least one red-sensitive silver halide emulsion layer on a support. The number of the silver halide emulsion layers and non-light-sensitive layers as well as the order of the layers on the support in the material is not specifically limited. A typical example is a silver halide color photographic material with a plurality of light-sensitive layer units each composed of a plurality of silver halide emulsion layers each with substantially the same color-sensitivity but with a different degree of sensitivity. The respective light-sensitive layers are unit light-sensitive layers each having a color-sensitivity to any of blue light, green light and red light. In such a multilayer silver halide color photographic material, in general, the order of the light-sensitive layer units on the support comprises a red-sensitive layer unit, a green-sensitive layer unit and a blue-sensitive layer unit formed on the support in this order. However, the order may be opposite to the above-mentioned one, depending on objects of the photographic material. As still another embodiment, a different color-sensitive layer may be sandwiched between two of the same color-sensitive layers.

Various non-light-sensitive layers such as interlayer may be provided between the above-described silver halide light-sensitive layers, or above or below the uppermost layer or lowermost layers.

This interlayer may contain various couplers and DIR compounds as described in JP-A-61-43748, JP-A-59-113438, JP-A-59-113440, JP-A-61-20037 and JP-A-61-20038, and it may also contain conventional color mixing preventing agents.

A preferred constitution of the plural silver halide emulsions of the respective light-sensitive layer units is a two-layered structure composed of a high-sensitivity emulsion layer and a low-sensitivity emulsion layer as described in West German Patent 1,121,470 and British Patent 923,045. In general, it is preferred that the plural light-sensitive layers are arranged on the support in such a way that the sensitivity degree of the layer gradually decreases in the direction toward the support. In this embodiment, a non-light-sensitive layer may be positioned between the plural silver halide emulsion layers. In another embodiment, a low-sensitivity emulsion layer is formed far from the support and a high-sensitivity emulsion layer is formed near to the support, as described in JP-A-57-112751, JP-A-62-200350, JP-A-62-206541, and JP-A-62-206543.

Specific examples of the layer structure on the support are an order of low-sensitivity blue-sensitive layer (BL)/high-sensitivity blue-sensitive layer (BH)/high-sensitivity green-sensitive layer (GH)/low-sensitivity green-sensitive-layer (GL)/high-sensitivity red-sensitive layer (RH)/low-sensitivity red-sensitive layer (RL) from the remotest side from the support; and an order of BH/BL/GL/GH/RH/RL; and an order of BH/BL/GH/GL/RL/RH.

Other examples include an order of blue-sensitive layer/GH/RH/GL/RL from the side farthest from the support, as described in JP-B-55-34932; and an order of blue-sensitive layer/GL/RL/GH/RH from the side farthest from the support, as described in JP-A-56-25738 and JP-A-62-63936.

An even further example is a three-layer unit structure as described in JP-B-49-15495, where the uppermost layer is a highest-sensitivity silver halide emulsion layer, the intermediate layer is a silver halide emulsion layer having a lower sensitivity than the uppermost layer, and the lowermost layer is a silver halide emulsion layer having an even lower sensitivity than the intermediate layer. That is, in the layer structure of this type, the sensitivity degree of each emulsion layer gradually reduced in the direction of the support. Even in the three-layer structure of this type, each of the same color-sensitivity layers may comprise three layers of middle-sensitivity emulsion layer/high-sensitivity emulsion layer/low-sensitivity emulsion layer formed in this order from the side farthest from the support, as described in JP-A-59-202464.

Still other examples of the layer structure of the photographic material of the present invention are an order of high-sensitivity emulsion layer/low-sensitivity emulsion layer/middle-sensitivity emulsion layer and an order of low-sensitivity emulsion layer/middle-sensitivity emulsion layer/high-sensitivity emulsion layer.

Where the photographic material of the invention has four or more layers, the layer structure thereof may be varied in the manner described above.

In order to improve the color reproducibility of the photographic material of the present invention, it is preferred to provide an interlayer effect donor layer (CL) with a different color sensitivity distribution from the other principal light-sensitive layers of BL, GL and RL, near to or adjacent to the principal light-sensitive layers, in accordance with the description in, for example, U.S. Pat. Nos. 4,663,271, 4,705,744 and 4,707,436, and JP-A-62-160448 and JP-A-63-89850.

As mentioned above, various layer structures and arrangements may be selected depending on the objects of the photographic material of the invention.

The silver halide in the photographic emulsion layer forming the photographic material of the present invention is preferably silver iodobromide, silver iodochloride or silver iodochlorobromide with a silver iodide content of about 30 mol % or less. Especially preferred is a silver iodobromide or silver iodochlorobromide with a silver iodide content of from about 2 mol % to about 10 mol %.

The silver halide grains in the photographic emulsions forming the photographic material of the present invention may have a regular crystalline form such as a cubic, octahedral or tetradecahedral form, or an irregular crystalline form such as a spherical or tabular form, or irregular crystalline forms having a crystal defect such as a twin plane, or a composite crystalline form composed of the above-mentioned regular and irregular crystalline forms.

The silver halide grains may be fine grains having a small grain size of about 0.2 μm or less or may be large grams having a large grain size of up to about 10 μm in terms of the diameter of the projected area. The grain emulsion may be either a polydispersed emulsion or a monodispersed emulsion.

The silver halide photographic emulsions used in the present invention may be prepared by various methods, for example, those described in *Research Disclosure* (RD) No. 17643 (December, 1978), pages 22 to 3 (I. Emulsion Preparation and Types); *RD* No. 18716 (November, 1979), pages 648; *RD* No. 307105 (November, 1989), pages 863 to 865; P. Glafkides, *Chimie et Physique Photographique* (Paul Montel, 1967); G. F. Duffin, *Photographic Emulsion Chemistry* (Focal Press, 1966); and V. L. Zelikman et al, *Making and Coating Photographic Emulsion* (Focal Press, 1964).

Monodispersed emulsions as described in U.S. Pat. Nos. 3,574,628 and 3,655,394 and British Patent 1,413,748 can also be advantageously used in the present invention.

Additionally, tabular grains having an aspect ratio of about 3 or more may also be used in the present invention. Such tabular grains may easily be prepared in accordance with various known methods, for example, as described in Gutoff, *Photographic Science and Engineering*, Vol. 14, pages 248 to 257 (1970); and U.S. Pat. Nos. 4,434,226, 4,414,310, 4,430,048, 4,439,520 and British Patent 2,112,157.

The silver halide grains forming the emulsions of the invention may have the same halogen composition throughout the entire grain, or they may have different halogen compositions between the inside part and the outside part of the grains, or they may have a layered structure. Further, the grains may have different halogen compositions due to an epitaxial bond, or they may have components other than silver halides, such as silver rhodanide or lead oxide, bonded with the silver halide matrix. Additionally, a mixture of various grains of different crystalline forms may be employed in the present invention.

The above-described emulsions may be either surface latent image type emulsions which form latent images essentially on the surfaces of the grains or internal latent image type emulsions which form latent images essentially in the insides of the grains, or they may also be composite emulsions forming latent images both on the surfaces of the grains and in the insides of the grains. However, the emulsions must be negative ones. The latter internal latent image type emulsions can be core/shell type internal latent image type emulsions as described in JP-A-63-264740. Preparation of such core/shell type internal latent image type emulsions is disclosed in JP-A-59-133542. The preferred thickness of the shell of the grains in the emulsion, which can vary depending on the method of development of the material, is approximately from 3 to 40 nm, especially preferably from 5 to 20 nm.

The emulsions for use in the invention are generally physically ripened, chemically ripened and/or spectrally sensitized. Additives used in such a ripening or sensitizing step are described in *Research Disclosure* Nos. 17643, 18716 and 307105, and the relevant descriptions in these references are shown in the Table mentioned below.

In preparing the photographic material of the present invention, two or more light-sensitive silver halide emulsions which are different from one another in at least one characteristic of grain size, grain size distribution, halogen composition, shape of grains and sensitivity may be blended and incorporated into one layer.

Surface-fogged silver halide grains as described in U.S. Pat. No. 4,082,553, internally-fogged silver halide grains as described in U.S. Pat. No. 4,626,498 and JP-A-59-214852 and colloidal silver are preferably incorporated into the light-sensitive silver halide emulsion layers and/or substantially non-light-sensitive hydrophilic colloid layers of the photographic material of the present invention. Internal-fogged or surface-fogged silver halide grains are silver halide grains capable of being uniformly (or non-imagewise) developed irrespective of the non-exposed part or exposed part of the photographic material of containing them. Preparation of such internal-fogged or surface-fogged silver halide grains is described in U.S. Pat. No. 4,626,498 and JP-A-59-214852.

The silver halide forming the inside core of an internal-fogged core/shell type silver halide grain may have the same halogen composition as that of the shell thereof or may have a different halogen composition from that of the shell. Such an internal-fogged or surface-fogged silver halide grain may be silver chloride, silver chlorobromide, silver iodobromide or silver chloroiodobromide. The grain size of the fogged silver halide grains is not specifically limited, but the grains preferably have a mean grain size of from 0.01 to 0.75 μm, especially preferably from 0.05 to 0.6 μm. The grains are not also specifically limited with respect to the shape thereof. They may be regular grains or they may be in the form of a polydispersed emulsion. However, they are preferably in the form of a monodispersed emulsion (where at least 95% by number or by weight of all the silver halide grains therein have a grain size falling within the range of the mean grain size ±40%).

The photographic material of the present invention preferably contains non-light-sensitive fine silver halide grains. Non-light-sensitive fine silver halide grains are fine silver halide grains which are not sensitive to the light used for imagewise exposure of the photographic material and are substantially not developed during development of the exposed material. These fine grains preferably are not previously fogged.

The fine silver halide grains have a silver bromide content of from 0 to 100 mol % and, if desired, they may additionally contain silver chloride and/or silver iodide. Preferably, they contain silver iodide in an amount of from 0.5 to 10 mol %.

The fine silver halide grains preferably have a mean grain size (as a mean value of a circle-corresponding diameter of the projected area) of from 0.01 to 0.5 μm, more preferably from 0.02 to 0.2 μm.

The fine silver halide grains may be prepared using the method as that used in preparing ordinary light-sensitive silver halide grains. In this case, the surfaces of the fine silver halide grains prepared do not need to be optically sensitized and spectral sensitization of the grains is unnecessary. However, prior to addition of the fine grains to the coating composition, it is desired to previously add a known stabilizer, such as triazole compounds, azaindene compounds, benzothiazolium compounds or, mercapto compounds or zinc compounds, to the coating composition. Incorporation of a colloidal silver into the fine silver halide grains-containing layer is also advantageous.

In preparing the photographic material of the present invention, the amount of the silver therein is preferably 6.0 g/m$^2$ or less, more preferably 4.5 g/m$^2$ or less.

Various known photographic additives which may be used in preparing the photographic materials of the present invention are described in the above-described three *Research Disclosure* references, and the relevant descriptions therein are shown in the following Table.

| Kind of Additive | RD 17643 (Dec. 1978) | RD 18716 (Nov. 1979) | RD 307105 (Nov. 1989) |
|---|---|---|---|
| 1. Chemical Sensitizers | p. 23 | p. 648, right column | p. 866 |
| 2. Sensitivity Enhancers | | p. 648, right column | |
| 3. Spectral Sensitizers Supersensitizers | pp. 23 to 24 | p. 648, right column to p. 649, right column | pp. 866 to 868 |
| 4. Whitening Agents | p. 24 | p. 647, right column | p. 868 |
| 5. Antifoggants Stabilizers | pp. 24 to 25 | p. 649, right column | pp. 868 to 870 |
| 6. Light-Absorbers Filter Dyes Ultraviolet Absorbers | pp. 25 to 26 | p. 649, right column to p. 650, left column | p. 873 |
| 7. Stain Inhibitors | p. 25, right column | p. 650, left to right column | p. 872 |
| 8. Color Image Stabilizers | p. 25 | p. 650, left column | p. 872 |
| 9. Hardening Agents | p. 26 | p. 651, left column | pp. 874 to 875 |
| 10. Binders | p. 26 | p. 651, left column | pp. 873 to 874 |
| 11. Plasticizers Lubricants | p. 27 | p. 650, right column | p. 876 |
| 12. Coating Aids Surfactants | pp. 26 to 27 | p. 650, right column | pp. 875 to 876 |
| 13. Antistatic Agents | p. 27 | p. 650, right column | pp. 876 to 877 |
| 14. Mat Agents | | | pp. 878 to 879 |

In order to prevent deterioration of the photographic properties of the photographic material of the invention on exposure to formaldehyde gas, compounds capable of reacting with formaldehyde so as to immobilize it, for example, those described in U.S. Pat. Nos. 4,411,987 and 4,435,503, are preferably incorporated into the material.

The photographic material of the present invention preferably contains a mercapto compound as described in U.S. Pat. Nos. 4,740,454 and 4,788,132 and JP-A-62-18539 and JP-A-1-283551.

The material also preferably contains a compound capable of releasing a foggant, a development accelerator, a silver halide solvent or a precursor thereof irrespective of the amount of the developed silver formed by development, as described in JP-A-1-106052.

The material also preferably contains a dye dispersion dispersed by the method described in published International Patent Application No. WO88/04794 and JP-A-1-502912 or a dye described in European Patent 317,308A, U.S. Pat. No. 4,420,555 and JP-A-1-259358.

Various color couplers can be incorporated into the photographic material of the present invention, and examples of suitable color couplers are described in the patent publications as referred to in the above-mentioned *RD*, No. 17643, VII-C to G and *RD*, No. 307105, VII-C to G.

Suitable preferred yellow couplers, for example, are those described in U.S. Pat. Nos. 3,933,501, 4,022,620, 4,326,024, 4,401,752, 4,248,961, JP-B-58-10739, British Patents 1,425,020, 1,476,760, U.S. Pat. Nos. 3,973,968, 4,314,023, 4,511,649, and European Patent 249,473A.

Suitable preferred magenta couplers are 5-pyrazolone compounds and pyrazoloazole compounds. For instance, those couplers described in U.S. Pat. Nos. 4,310,619, 4,351,897, European Patent 73,636, U.S. Pat. Nos. 3,061,432, 3,725,067, RD No. 24220 (June, 1984), JP-A-60-33552, *RD* No. 24230 (June, 1984), JP-A-60-43659, JP-A-61-72238, JP-A-60-35730, JP-A-55-118034, JP-A-60-185951, U.S. Pat. Nos. 4,500,630, 4,540,654, 4,556,630, and International Patent Application WO 88/04795 are preferred.

Typical preferred cyan couplers are phenol couplers and naphthol couplers. For instance, those described in U.S. Pat. Nos. 4,052,212, 4,146,396, 4,228,233, 4,296,200, 2,369,929, 2,801,171, 2,771,162, 2,895,826, 3,772,002, 3,758,308, 4,334,011, 4,327,173, West German Patent (OLS) No. 3,329,729, European Patents 121,365A and 249,453A, U. S. Pat. Nos. 3,466,622, 4,333,999, 4,775,616, 4,451,559, 4,427,767, 4,690,889, 4,254,212 and 4,296,199, and JP-A-61-42658 are preferably red. In addition, pyrazoloazole couplers described in JP-A-64-553, JP-A-64-554, JP-A-64-555 and JP-A-64-556, as well as imidazole couplers as described in U.S. Pat. No. 4,818,672 may also be used.

Polymerized dye-forming couplers may also be used, and typical examples of such polymerized couplers are described in U.S. Pat. Nos. 3,451,820, 4,080,211, 4,367,282, 4,409,320 and 4,576,910, British Patent 2,102,137, and European Patent 341,188A.

Couplers capable of forming colored dyes having an appropriate diffusibility may also be used, and those described in U.S. Pat. No. 4,366,237, British Patent 2,125,570, European Patent 96,570, and West German Patent (OLS) No. 3,234,533 are preferred.

Examples of preferred colored couplers for correcting the unnecessary absorption of colored dyes are those described in *RD* No. 17643, VII-G, *RD* No. 7105, VII-G, U.S. Pat. No. 4,163,670, JP-B-57-39413, U.S. Pat. Nos. 4,004,929 and 4,138,258, and British Patent 1,146,368. Additionally, couplers correcting the unnecessary absorption of the colored dye due to the phosphor dye released during coupling, as described in U.S. Pat. No. 4,774,181, as well as couplers having a dye precursor group capable of reacting with a developing agent to form dyes, as split-off groups, as described in U.S. Pat. No. 4,777,120 are also advantageously used.

Couplers capable of releasing a photographically useful residue on coupling may also be used in the present invention. For instance, suitable preferred DIR couplers releasing a development inhibitor are described in the patent publications referred to in the above-mentioned *RD*, No. 17643, Item VII-F and *RD*, No. 307105, VII-F, as well as those described in JP-A-57-151944, JP-A-57-154234, JP-A-60-184248, JP-A-63-37346 and JP-A-63-37350 and U.S. Pat. Nos. 4,248,962 and 4,782,012, in addition to the compounds of formula (I) of the present invention.

Couplers releasing a bleaching accelerator, which are described in *RD*, No. 11449, *RD*, No. 24241 and JP-A-61-201247, are effective for shortening the processing time with a processing solution having a bleaching ability. In particular, they are especially effectively added to a photographic material containing the above-mentioned tabular silver halide grains.

Typical preferred couplers imagewise releasing a nucleating agent or development accelerator during development are described in British Patents 2,097,140 and 2,131,188, and JP-A-59-157638 and JP-A-59-170840. In addition, compounds capable of releasing a foggant, a development accelerator or a silver halide solvent by a redox reaction of the material with the oxidation product of a developing agent, as described in JP-A-60-107029, JP-A-60-252340 and JP-A-1-44940, are also advantageously used.

Additionally, examples of compounds which may be incorporated into the photographic materials of the present invention include the competing couplers described in U.S. Pat. No. 4,130,427; poly-valent couplers described in U.S. Pat. Nos. 4,238,472, 4,338,393 and 4,310,618; DIR redox compound-releasing couplers, DIR coupler-releasing couplers, DIR coupler-releasing redox compounds and DIR redox compound-releasing couplers described in JP-A-60-185950 and 62-24252; couplers releasing a dye which recolors after release from the coupler, as described in European Patents 173,302A and 313,308A; ligand-releasing couplers described in U.S. Pat. No. 4,555,477; leuco dye-releasing couplers described in JP-A-63-75747; and couplers releasing a fluorescent dye as described in U.S. Pat. No. 4,774,181.

The above-described couplers can be incorporated into the photographic materials of the present invention using various known dispersion methods.

For instance, an oil-in-water dispersion method may be employed for the purpose. Examples of high boiling point solvents usable in the method are described in U.S. Pat. No. 2,322,027. These are used also for dispersion of the compounds of formula (I). Auxiliary solvents having a boiling point of from about 30° to 160° C., preferably from 50° to 160° C., may also be employed along with these high boiling point solvents. Examples of suitable auxiliary organic solvents are ethyl acetate, butyl acetate, ethyl propionate, methyl ethyl ketone, cyclohexanone, 2-ethoxyethyl acetate and dimethylformamide.

A latex dispersion method may also be employed to incorporate couplers into the photographic material of the present invention. The steps of carrying out the dispersion method, the effect of the method and examples of latexes usable in the method for impregnation are described in U.S. Pat. No. 4,199,363 and West German Patent (OLS) Nos. 2,541,274 and 2,541,230.

The color photographic materials of the present invention preferably contain phenethyl alcohol as well as other various antiseptics or fungicides, for example, those described in JP-A-63-257747, JP-A-62-272248 and JP-A-1-80941, such as 1,2-benzisothiazolin-3-one, n-butyl p-hydroxybenzoate, phenol, 4-chloro-3,5-dimethylphenol, 2-phenoxyethanol or 2-(4-thiazolyl)benzimidazole.

The present invention is applicable to various color photographic materials. For instance, typical examples include color negative films for general use or for movie use, color reversal films for slide use or for television use, as well as color papers, color positive films and color reversal papers.

Suitable supports which are usable in the present invention are described in, for example, the above-described *RD,* No. 17643, page 28, *RD,* No. 18716, from page 647, right column to page 648, left column, and RD, No. 307105, page 879.

It is preferred that the total film thickness of all the hydrophilic colloid layers on the surface of the support with emulsion layers of the photographic material of the present invention is 28 μm or less, preferably 23 μm or less, more preferably 18 μm or less, especially preferably 16 μm or less. It is also preferred for the photographic material of the invention to have a film swelling rate ($T_{\frac{1}{2}}$) of 30 seconds or less, preferably 20 seconds or less. The film thickness as referred to herein is the thickness measured under controlled conditions of a temperature of 25° C. and a relative humidity of 55% (for 2 days); and the film swelling rate as referred to herein may be measured using any means known in the art. For instance, the thickness may be measured using a swellometer of the model as described in A. Green et al., *Photographic Science Engineering,* Vol. 19, No. 2, pages 124 to 129. The film swelling rate ($T_{\frac{1}{2}}$) is defined as follows: 90% of the maximum swollen thickness of the photographic material as processed in a color developer under the conditions of 30° C. and 3 minutes and 15 seconds is designated a saturated swollen thickness. The time necessary for attaining half ($\frac{1}{2}$) of the saturated swollen thickness is defined as the film swelling rate ($T_{\frac{1}{2}}$).

The film swelling rate ($T_{\frac{1}{2}}$) can be adjusted by adding a hardening agent to the gelatin of the binder or by varying the condition of storage of the coated photographic material. Additionally, the photographic material of the present invention preferably has a swelling degree of from 150 to 400%. The swelling degree as referred to herein is calculated from the maximum swollen film thickness obtained under the above-described conditions using the formula:

[(maximum swollen film thickness)−(original film thickness)]/(original film thickness).

The photographic material of the present invention preferably has a hydrophilic colloid layer (backing layer) with a total dry thickness of from 2 μm to 20 μm, on the surface opposite to the surface coated with the emulsion layers. The backing layer preferably contains the above-described light-absorber, filter dye, ultraviolet absorber, antistatic agent, hardening agent, binder, plasticizer, lubricant, coating aid, surfactant, etc. The backing layer preferably has a swelling degree of from 150 to 500%.

The color photographic material of the present invention can be developed using any conventional method, for example, in accordance with the process described in the above-described *RD,* No. 17643, pages 28 and 29, *RD,* No. 18716, page 615, from left column to right column, and *RD,* No. 307105, pages 880 and 881.

The color developer used for development of the photographic material of the present invention is preferably an aqueous alkaline solution containing an aromatic primary amine color-developing agent. p-Phenylenediamine compounds are preferably used as a color developing agent though aminophenol compounds are also useful. Specific examples of p-phenylenediamine compounds usable as color-developing agents include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, as well as the sulfates, hydrochlorides and p-toluenesulfonates of these compounds. Above all, 3-methyl-4-amino-N-ethyl-N-β-hydroxyethylaniline sulfate is especially preferred. These compounds can be used as combination of two or more thereof as needed.

The color developer generally contains a pH buffer such as alkali metal carbonates, borates or phosphates, and a development inhibitor or antifoggant such as bromides, iodides, benzimidazoles, benzothiazoles or mercapto compounds. If desired, the color developer may also contain various preservatives such as hydroxylamine, diethylhydroxylamine, sulfites, hydrazines such as N,N-biscarboxymethylhydrazine, phenylsemicarbazides, triethanolamine, catechol-sulfonic acids; an organic solvent such as ethylene glycol, and diethylene glycol; a development accelerator such as benzyl alcohol, polyethylene glycol, quaternary ammonium salts, and amines; a dye-forming coupler; a competitive coupler; an auxiliary developing agent such as 1-phenyl-3-pyrazolidone; a tackifier; as well as various chelating agents such as aminopolycarboxylic acids, aminopolyphosphonic acids, alkylphosphonic acids, and phosphonocarboxylic acids. Specific examples of chelating agents which may be incorporated into the color developer are ethylenediaminetetraacetic acid, nitrilotriacetic acid, diethylenetriaminepentaacetic acid, cyclohexanediaminetetraacetic acid, hydroxylethyliminodiacetic acid, 1-hydroxyethylidene-1,1-diphosphonic acid, nitrilo-N,N,Ntrimethylenephosphonic acid, ethylenediamine-N,N,N,N-tetramethylene-phosphonic acid, ethylenediamine-di(ohydroxyphenylacetic acid) and the salts thereof.

Where the photographic material is reversal processed, in general, it is first subjected to a black-and-white development and then subjected to a color development. A black-and-white developer, which contains a conventional black-and-white developing agent, for example, dihydroxybenzenes such as hydroquinone, 3-pyrazolidones such as 1-phenyl-3-pyraozlidone, and aminophenols such as N-methyl-p-aminophenol, alone or in combination, is used as a first black-and-white development.

The color developer and the black-and-white developer generally has a pH of from 9 to 12. The amount of the replenisher for the developer is generally 3 liters or less per $m^2$ of the material to be processed, although this will depend on the color photographic material to be processed. It may be reduced to 500 ml or less per $m^2$ of the material to be processed, by lowering the bromide ion concentration in the replenisher. Where the amount of the replenisher is reduced, it is preferred to reduce the contact area of the surface of the processing solution in the processing tank with air to prevent vaporization and air oxidation of the solution.

The contact surface area of the processing solution with air in the processing tank is represented by the opening ratio which is defined by the following formula:

Opening Ratio=(Contact Surface Area ($cm^2$) of Processing Solution with Air)/(Volume ($cm^3$) of Processing Tank)

The above-described opening ratio is preferably 0.1 or less, more preferably from 0.001 to 0.05. Various means can be employed to reduce the opening ratio, which include, for example, use of a masking substance such as a lid floating on the surface of the processing solution in the processing tank, use of a movable lid described in JP-A-1-82033 and employment of the slit-developing method described in JP-A-63-216050. Reduction of the opening ratio is preferably employed not only during color development and black-and-white development but also during subsequent steps such as bleaching, bleach-fixation, fixation, rinsing and stabilization steps. In addition, the amount of the replenisher added may also be reduced by suppressing accumulation of bromide ions in the developer.

The time for color development is generally within the range of from 2 minutes to 5 minutes, but the processing time may be shortened by elevating the processing temperature, elevating the pH value of the processing solution and elevating the concentration of the processing solution.

After color development, the photographic emulsion layer is generally bleached. Bleaching may be effected simultaneously with fixation (bleach-fixation) or separately therefrom. In order to accelerate the processing speed, a method of bleaching followed by bleach-fixation may also be employed. If desired, a system using a bleach-fixing bath employing two continuous tanks, a system of fixation followed by bleach-fixation, or a system of bleach-fixation followed by bleaching may also be employed, depending on the objects. Examples of bleaching agent which can be used include, for example, compounds of polyvalent metals such as iron(III), as well as peracids, quinones and nitro compounds. Specific examples of bleaching agents suitable in the present invention include organic complexes of iron(III), such as complexes thereof with amino-polycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid or glycol ether-diaminetetraacetic acid or with organic acids such as citric acid, tartaric acid or malic acid. Among them, aminopolycarboxylato/iron(III) complexes such as ethylenediaminetetraacetato/iron(III) complex and 1,3-diaminopropanetetraacetato/iron(III) complex are preferred in view of the rapid processability thereof and of prevention of environmental pollution. The aminopolycarboxylato/iron(III) complexes are especially useful both in a bleaching solution and in a bleach-fixing solution. The bleaching solution or bleach-fixing solution containing these aminopolycarboxylato/iron(III) complexes generally has a pH of from 4.0 to 8.0, but the solution may have a lower pH for rapid processing if desired.

The bleaching solution, the bleach-fixing solution and the preceding bath may contain a bleaching accelerating agent, if desired. Various bleaching accelerating agents are known, and examples of agents which are advantageously used in the present invention include mercapto group- or disulfide group-containing compounds described in U.S. Pat. No. 3,893,858, German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623 and JP-A-53-28426, *RD*, No. 17129 (July, 1978); thiazolidine derivatives as described in JP-A-50-140129; thiourea derivatives as described in JP-B-45-8506, JP-A-52-20832 and JP-A-53-32735 and U.S. Pat. No. 3,706,561; iodide salts as described in German Patent 1,127,715 and JP-A-58-16235; polyoxyethylene compounds as described in German Patents 966,410 and 2,748,430; polyamine compounds as described in JP-B-45-8836; other compounds as described in JP-A-49-40943, JP-A-49-59644, JP-A-53-94927, JP-A-54-35727, JP-A-55-26506 and JP-A-58-163940; and bromide ions. Above all, mercapto group- or disulfide group-containing compounds, in particular, those as described in U.S. Pat. No. 3,893,858, German Patent 1,290,812 and JP-A-53-95630 are preferred, because they have a large accelerating effect. In addition, compounds described in U.S. Pat. No. 4,552,834 are also preferred. These bleaching accelerators may be incorporated into the photographic material of the invention. Where the photographic material of the invention is a picture-taking color photographic material and it is bleach-fixed, these bleaching accelerators are especially effective.

The bleaching solution and bleach-fixing solution may further contain, in addition to the above-described components, various organic acids for the purpose of preventing bleaching stains. Especially preferred organic acids for this purpose are those having an acid dissociating constant (pKa) of from 2 to 5. For instance, acetic acid, propionic acid and hydroxyacetic acid are preferably used.

Suitable fixing agents in the fixing solution or bleach-fixing solution for the photographic material of the invention are thiosulfates, thiocyanates, thioether compounds, thioureas, and a large amount of iodide salts. Thiosulfates are generally used for the purpose. Above all, ammonium thiosulfate is most widely used. Additionally, combinations of thiosulfates and thiocyanates, thioether compounds or thioureas are also preferred. Preferred preservatives used in the fixing solution or bleach-fixing solution are sulfites, bisulfites and carbonyl-bisulfite adducts, as well as sulfinic acid compounds as described in European Patent 294769A. Further, the fixing solution or bleach-fixing solution may advantageously contain various aminopolycarboxylic acids or organic phosphonic acids for the purpose of stabilizing the solution.

The fixing solution or bleach-fixing solution preferably contains compounds having a pKa of from 6.0 to 9.0, preferably imidazoles such as imidazole, 1-methylimidazole, 1-ethylimidazole or 2-methylimidazole, in an amount of from 0.1 to 10 mol/-liter, for the purpose of adjusting the pH of the solution.

The total time for the desilvering process is preferably shortened such that the time is within the range where desilvering insufficiency does not occur. For instance, the time is preferably from 1 minute to 3 minutes, more preferably from 1 minute to 2 minutes. The processing temperature may be from 25° C. to 50° C. and preferably is from 35° C. to 45° C. In such a preferred temperature range, the desilvering speed is accelerated and generation of stains in the processed material may effectively be prevented.

In the desilvering process, it is preferred to promote stirring of the processing solution during the process as much as possible. Examples where stirring means for affirmatively stirring the photographic material during the desilvering step is enhanced include a method of jetting a 'stream of the processing solution against the emulsion-coated surface of the material, as described in JP-A-62-183460; a method of promoting the stirring effect by the use of a rotating means, as described in JP-A-62-183461; a method of moving the photographic material being processed in the processing bath while the emulsion-coated surface of the material is brought into contact with a wiper blade present in the processing bath, whereby the processing solution as applied to the emulsion-coated surface of the material is a turbulent manner and the stirring effect is promoted; and a method of increasing the total amount of processing solution circulated. These enhanced stirring means are effective for any of the bleaching solution, bleach-fixing solution and fixing solution. It is believed that enhancing the stirring effect of the processing solution promotes penetration of the bleaching agent and fixing agent into the emulsion layer of the photographic material being processed and, as a result, the desilvering rate in processing the material is elevated. The above-described reinforced stirring means is more effective, when a bleaching accelerator is incorporated into the processing solution. As a result, the bleaching accelerating effect is markedly augmented, and the fixation preventing effect by the bleaching accelerator are eliminated.

The photographic material of the present invention can be processed with an automatic developing machine. Preferably, the automatic developing machine used for processing the material of the present invention includes a photographic material-conveying means as described in JP-A-60-191257, JP-A-60-191258 and JP-A-60-191259. As JP-A-60-191257 discloses, the conveying means may noticeably reduce the carry-over amount from the pre-bath to the subsequent bath and therefore it is extremely effective for preventing deterioration of the processing solution being used. Thus, the conveying means is especially effective in shortening the processing time in each processing step and in reducing the amount of the replenisher for each processing bath.

The silver halide color photographic material of the present invention is generally rinsed in water and/or stabilized, after it is desilvered. The amount of water used in the rinsing step can be varied widely, in accordance with the characteristics of the photographic material being processed (for example, depending upon the components present in the material, such as the coupler and so on) or the use of the material, as well as the temperature of the rinsing water, the number of the rinsing tanks (the number of the rinsing stages), the replenishment system, i.e., normal current or countercurrent, and other various kinds of conditions. The relationship between the number of rinsing tanks and the amount of rinsing water in a multistage countercurrent rinsing system can be obtained by the method described in *Journal of the Society of Motion Picture and Television Engineers,* Vol. 64, pages 248 to 253 (May, 1955).

According to the multistage countercurrent system described in the above-described reference, the amount of the rinsing water to be used can be reduced noticeably, but because of the prolongation of the residence time of the water in the rinsing tank, bacteria propagate in the tank so that floating substances generated by the propagation of bacteria adhere to the surface of the material as it is processed. Accordingly, problems often occur with the above system. In processing the photographic material of the present invention, the method of reducing the amounts of calcium and magnesium ions, which is described in JP-A-62-288838, is extremely effective to overcome this problem. In addition, isothiazolone compounds and thiabendazoles described in JP-A-57-8542; chlorine-containing bactericides such as chlorinated sodium isocyanurates; and benzotriazoles and other bactericides described in H. Horiguchi, *Chemistry of Bactericidal and Fungicidal Agents* (1986, by Sankyo Publishing Co., Japan), *Bactericidal and Fungicidal Techniques to Microorganisms,* edited by Association of Sanitary Technique, Japan (1982, by Kogyo Gijutsu-kai, Japan), and *Encyclopedia of Bactericidal and Fungicidal Agents,* edited by Nippon Bactericide and Fungicide Association, Japan (1986), can also be used.

The pH of the rinsing water to be used for processing the photographic material of the present invention is from 4 to 9, preferably from 5 to 8. The temperature of the rinsing water and the rinsing time can also be varied in accordance with the characteristics of the photographic material being processed as well as the use thereof, but in general, the temperature is from 15° to 45° C. and the time is from 20 seconds to 10 minutes, and preferably the temperature is from 25° to 40° C. and the time is from 30 seconds to 5 minutes. Alternatively, the photographic material of the present invention may also be processed directly with a stabilizing solution in place of rinsing with water. Any known methods, for example, as described in JP-A-57-8543, JP-A-58-14834 and JP-A-60-220345, can be employed for stabilization.

As noted above, the material can also be stabilized, following the rinsing step. One example comprises using a stabilizing bath containing a dye stabilizer and a surfactant, which is used as a final bath for picture-taking color photographic materials. Examples of dye stabilizers usable for the purpose are aldehydes such as formaldehyde and glutaraldehyde, N-methylol compounds, hexamethylenetetramine and aldehydesulfite adducts.

The stabilizing bath may also contain various chelating agents and fungicides, if desired.

The overflow from the rinsing and/or stabilizing solutions because of addition of replenishers thereto may be re-used in the other steps such as the preceding desilvering step.

Where the photographic material of the present invention is processed with an automatic developing machine system and the processing solutions used in the step evaporate and thus thicken, it is desired to add water to the solutions to adjust the concentration of the solutions.

The silver halide color photographic material of the present invention can contain a color developing agent for the purpose of simplifying and accelerating the processing of the material. Various precursors of color developing agents are preferably used to incorporate a color developing agent into the photographic material. For example, the indoaniline compounds described in U.S. Pat. No. 3,342,597, Schiff base compounds described in U.S. Pat. No. 3,342,599 and RD, Nos. 14850 and 15159, aldol compounds described in RD, No. 13924, metal complexes described in U.S. Pat. No. 3,719,492 and urethane compounds described in JP-A-53-135628, can be used as precursors.

The silver halide color photographic material of the present invention can contain various kinds of 1-phenyl-3-pyrazolidones, if desired, for the purpose of accelerating the color developability thereof. Specific examples of these compounds are described in JP-A-56-64339, JP-A-57-144547 and JP-A-58-115438.

The processing solutions for the photographic material of the invention are used at 10° C. to 50° C. In general, a processing temperature of from 33° C. to 38° C. is conventional, but a higher temperature can be used to accelerate the processing or to shorten the processing time, or on the contrary, a lower temperature can be used to improve the quality of images formed and to improve the stability of the processing solution used.

The present invention is also applicable to heat-developable photographic materials as described in U.S. Pat. No. 4,500,626, JP-A-60-133449, JP-A-59-218443 and JP-A-61-238056 and European Patent 210,660A2.

The present invention is explained in more detail by way of the following examples, which, however, are not intended to be construed as limiting the scope of the present invention. Unless otherwise indicated herein, all parts, percents, ratios and the like are by weight.

EXAMPLE 1

Preparation of Sample No. 101:

Plural layers described below were formed on a cellulose triacetate film support having a subbing layer thereon, to form a multilayer color photographic material sample (Sample No. 101).

Compositions of Light-Sensitive Layers:

The numbers corresponding to the respective components described below indicate the amounts coated, which are represented in units of g/m$^2$. For the silver halides and the colloidal silver, the number indicates the amount of silver therein. For the couplers, additives and gelatin, the number indicates the amount thereof on a coated basis. For the sensitizing dyes, the amount coated is represented in units of mols per mol of the silver halide in the same layer. The following abbreviations were used for the additives employed. Where one additive compound has multiple effects, one typical effect was referenced.

UV: Ultraviolet Absorber
Solv: High Boiling Point Organic Solvent
ExF: Dye
ExS: Sensitizing Dye
ExC: Cyan Coupler
ExM: Magenta Coupler
ExY: Yellow Coupler
Cpd: Additive

| First Layer (Anti-Halation Layer) | |
|---|---|
| Black Colloidal Silver | 0.15 |

-continued

| | |
|---|---|
| Gelatin | 2.33 |
| UV-1 | $3.0 \times 10^{-2}$ |
| UV-2 | $6.0 \times 10^{-2}$ |
| UV-3 | $7.0 \times 10^{-2}$ |
| Solv-1 | 0.16 |
| Solv-2 | 0.10 |
| ExF-1 | $1.0 \times 10^{-2}$ |
| ExF-2 | $4.0 \times 10^{-2}$ |
| ExF-3 | $5.0 \times 10^{-3}$ |
| Cpd-6 | $1.0 \times 10^{-3}$ |
| Second Layer (Low-Sensitivity Red-Sensitive Emulsion Layer): | |
| Silver Iodobromide Emulsion (AgI 4.0 mol %; uniform AgI type grains; sphere-corresponding diameter 0.4 μm; coefficient of variation of sphere-corresponding diameter 30%; tabular grains having aspect ratio (diameter/thickness) of 3.0) | 0.38 as Ag |
| Silver Iodobromide Emulsion (AgI 6.0 mol %; high-internal AgI core/shell grains with core/shell ratio of 1/2; sphere-corresponding diameter 0.45 μm; coefficient of variation of sphere-corresponding diameter 23%; tabular grains having aspect ratio (diameter/thickness) of 2.0) | 0.20 as Ag |
| Gelatin | 0.80 |
| ExS-1 | $2.4 \times 10^{-4}$ |
| ExS-2 | $1.4 \times 10^{-4}$ |
| ExS-5 | $2.3 \times 10^{-4}$ |
| ExS-7 | $4.1 \times 10^{-6}$ |
| ExC-1 | 0.20 |
| ExC-2 | $8.0 \times 10^{-2}$ |
| ExC-3 | $8.0 \times 10^{-2}$ |
| Third Layer (Middle-Sensitivity Red-Sensitive Emulsion Layer): | |
| Silver Iodobromide Emulsion (AgI 6.0 mol %; high-internal AgI core/shell grains with core/shell ratio of 1/2; sphere-corresponding diameter 0.65 μm; coefficient of variation of sphere-corresponding diameter 23%; tabular grains with aspect ratio (diameter/thickness) of 2.0) | 0.85 as Ag |
| Gelatin | 1.50 |
| ExS-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.40 |
| ExC-2 | $2.0 \times 10^{-2}$ |
| ExC-3 | 0.12 |
| ExM-7 | $3.0 \times 10^{-3}$ |
| UV-2 | $5.7 \times 10^{-2}$ |
| UV-3 | $5.7 \times 10^{-2}$ |
| Fourth Layer (High-Sensitivity Red-Sensitive Emulsion Layer): | |
| Silver Iodobromide Emulsion (AgI 9.3 mol %; multilayer grains with Ag ratio of 3/4/2, having AgI content of 24, 0 and 6 mol %, respectively, from the inside core; sphere-corresponding diameter 0.75 μm; coefficient of variation of sphere-corresponding diameter 23%; tabular grains with aspect ratio (diameter/thickness) of 2.5) | 1.49 as Ag |
| Gelatin | 1.40 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $8.0 \times 10^{-2}$ |
| ExC-4 | $9.0 \times 10^{-2}$ |
| Solv-1 | 0.20 |
| Solv-2 | 0.53 |
| Fifth Layer (Interlayer): | |

-continued

| | |
|---|---|
| Gelatin | 0.70 |
| Cpd-1 | 0.13 |
| Polyethyl Acrylate Latex | $8.0 \times 10^{-2}$ |
| Solv-1 | $8.0 \times 10^{-2}$ |
| Sixth Layer (Low-Sensitivity Green-Sensitive Emulsion Layer): | |
| Silver Iodobromide Emulsion (AgI 4.0 mol %; uniform AgI type grains; sphere-corresponding diameter 0.33 μm; coefficient of variation of sphere-corresponding diameter 37%; tabular grains with aspect ratio (diameter/thickness) of 2.0) | 0.20 as Ag |
| Gelatin | 0.50 |
| ExS-3 | $1.5 \times 10^{-4}$ |
| ExS-4 | $4.4 \times 10^{-4}$ |
| ExS-5 | $9.2 \times 10^{-5}$ |
| ExM-5 | 0.20 |
| ExM-7 | $3.0 \times 10^{-3}$ |
| Solv-1 | 0.13 |
| Solv-4 | $1.0 \times 10^{-2}$ |
| Seventh Layer (Middle-Sensitivity Green-Sensitive Emulsion Layer): | |
| Silver Iodobromide Emulsion (AgI 4.0 mol %; uniform AgI type grains sphere-corresponding diameter 0.55 μm coefficient of variation of sphere-corresponding diameter 15%; tabular grains with aspect ratio (diameter/thickness) of 4.0) | 0.24 as Ag |
| Gelatin | 0.55 |
| ExS-3 | $2.1 \times 10^{-4}$ |
| ExS-4 | $6.3 \times 10^{-4}$ |
| ExS-5 | $1.3 \times 10^{-4}$ |
| ExM-5 | 0.17 |
| ExM-7 | $4.0 \times 10^{-3}$ |
| ExY-8 | $3.0 \times 10^{-2}$ |
| Solv-1 | 0.13 |
| Solv-4 | $1.0 \times 10^{-2}$ |
| Eighth Layer (High-Sensitivity Green-Sensitive Emulsion Layer): | |
| Silver Iodobromide Emulsion (AgI 8.8 mol %; multilayer grains with Ag ratio of 3/4/2, having AgI content of 24, 0 and 3 mol %, respectively, from the inside core; sphere-corresponding diameter 0.75 μm; coefficient of variation of sphere-corresponding diameter 23%; tabular grains with aspect ratio (diameter/thickness) of 1.6) | 0.52 as Ag |
| Gelatin | 0.65 |
| ExS-4 | $4.3 \times 10^{-4}$ |
| ExS-5 | $8.6 \times 10^{-5}$ |
| ExS-8 | $2.8 \times 10^{-5}$ |
| ExM-5 | $9.0 \times 10^{-2}$ |
| ExM-6 | $1.0 \times 10^{-2}$ |
| ExY-8 | $3.0 \times 10^{-2}$ |
| ExC-1 | $1.0 \times 10^{-2}$ |
| EXC-4 | $1.0 \times 10^{-2}$ |
| Solv-1 | 0.23 |
| Solv-2 | $5.0 \times 10^{-2}$ |
| Solv-4 | $1.0 \times 10^{-2}$ |
| Cpd-8 | $1.0 \times 10^{-2}$ |
| Ninth Layer (Interlayer): | |
| Gelatin | 0.56 |
| Cpd-1 | $4.0 \times 10^{-2}$ |
| Polyethyl Acrylate Latex | $5.0 \times 10^{-2}$ |
| Solv-1 | $3.0 \times 10^{-2}$ |
| UV-4 | $3.0 \times 10^{-2}$ |
| UV-5 | $4.0 \times 10^{-2}$ |
| Tenth Layer (Interlayer Effect Donor Layer to Red-Sensitive Layer): | |
| Silver Iodobromide Emulsion (AgI 8.0 mol %; high-internal AgI core/shell grains with core/shell ratio of 1/2; sphere-corresponding diameter 0.65 μm, coefficient of variation of sphere-corresponding diameter 25 %; tabular grains with aspect ratio (diameter/thickness) of 2.0) | 0.65 as Ag |
| Silver Iodobromide Emulsion (AgI 4.0 mol %; uniform AgI type grains; sphere-corresponding diameter 0.4 μm; coefficient of variation of sphere-corresponding diameter 30%; tabular grain with aspect ratio (diameter/thickness) of 3.0) | 0.20 as Ag |
| Gelatin | 0.90 |
| ExS-3 | $6.7 \times 10^{-4}$ |
| ExM-10 | 0.20 |
| Solv-1 | 0.30 |
| Solv-6 | $3.0 \times 10^{-2}$ |
| Eleventh Layer (Yellow Filter Layer): | |
| Yellow Colloidal Silver | $9.0 \times 10^{-2}$ |
| Gelatin | 0.84 |
| Cpd-2 | 0.13 |
| Solv-1 | 0.13 |
| Cpd-1 | $8.0 \times 10^{-2}$ |
| Cpd-6 | $2.0 \times 10^{-3}$ |
| H-1 | 0.25 |
| Twelfth Layer (Low-sensitivity Blue-Sensitive Emulsion Layer): | |
| Silver Iodobromide Emulsion (AgI 4.5 mol %; uniform AgI type grains sphere-corresponding diameter 0.7 μm; coefficient of variation of sphere-corresponding diameter 15%; tabular grains with aspect ratio (diameter/thickness) of 7.0) | 0.55 as Ag |
| Silver Iodobromide Emulsion (AgI 3.0 mol %; uniform AgI type grains; sphere-corresponding diameter 0.3 μm; coefficient of variation of sphere-corresponding diameter 30%; tabular grains with aspect ratio (diameter/thickness) of 7.0) | 0.35 as Ag |
| Gelatin | 2.18 |
| ExS-6 | $9.0 \times 10^{-4}$ |
| ExC-1 | 0.10 |
| ExC-2 | 0.10 |
| ExY-11 | 1.50 |
| Solv-1 | 0.54 |
| Thirteenth Layer (Interlayer): | |
| Gelatin | 0.40 |
| ExY-12 | 0.15 |
| Solv-1 | 0.19 |
| Fourteenth Layer: (High-Sensitivity Blue-Sensitive Emulsion Layer): | |
| Silver Iodobromide Emulsion (AgI 10.0 mol %; high-internal AgI grains; sphere-corresponding diameter 1.0 μm; coefficient of variation of sphere-corresponding diameter 25%; multilayer twin tabular grains with aspect ratio (diameter/thickness) of 2.0) | 0.40 as Ag |
| Gelatin | 0.49 |
| ExS-6 | $2.6 \times 10^{-4}$ |
| ExY-9 | $1.0 \times 10^{-3}$ |
| ExY-11 | 0.25 |
| ExY-12 | $2.5 \times 10^{-2}$ |
| ExC-1 | $1.0 \times 10^{-2}$ |
| Solv-1 | $9.0 \times 10^{-2}$ |
| Fifteenth Layer (First Protective Layer): | |
| Fine Silver Iodobromide Grain Emulsion (AgI 2.0 mol %; uniform AgI type grains; sphere-corresponding diameter 0.07 μm) | 0.12 as Ag |
| Gelatin | 0.63 |
| UV-4 | 0.11 |
| UV-5 | 0.18 |
| Solv-5 | $2.0 \times 10^{-2}$ |
| Cpd-5 | 0.10 |
| Polyethyl Acrylate Latex | $9.0 \times 10^{-2}$ |
| Sixteenth Layer (Second Protective Layer): | |
| Fine Silver Iodobromide Grain Emulsion (AgI 2.0 mol %; uniform AgI type grains; sphere-corresponding diameter 0.07 μm) | 0.36 as Ag |
| Gelatin | 0.85 |
| B-1 (diameter 1.5 μm) | $8.0 \times 10^{-2}$ |

-continued

| | |
|---|---|
| B-2 (diameter 1.5 μm) | $8.0 \times 10^{-2}$ |
| B-3 | $2.0 \times 10^{-2}$ |
| W-4 | $2.0 \times 10^{-2}$ |
| H-1 | 0.18 |

The sample further contained, in addition to the above-listed components, 1,2-benzisothiazolin-3-one (200 ppm to gelatin on average), n-butyl p-hydroxybenzoate (about 1,000 ppm to gelatin on average), and 2-phenoxyethanol (about 10,000 ppm to gelatin on average). In addition, it further contained (B-4), (B-5), (F-1), (F-2), (F-3), (F-4), (F-5), (F-6), (F-7), (F-8), (F-9), (F-10), (F-11), (F-12), (F-13) as well as an iron salt, a lead salt, a gold salt, a platinum salt, an iridium salt and a rhodium salt.

The respective layers contained, in addition to the above-described components, surfactants (W-1), (W-2) and (W-3) as a coating aid and a emulsifying and dispersing agent.

The chemical structural formulae or the names of the compounds used for preparing the above sample are described below.

UV-1

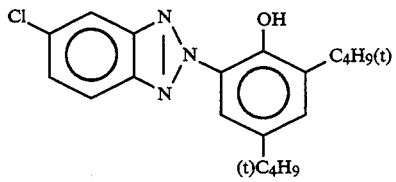

UV-2

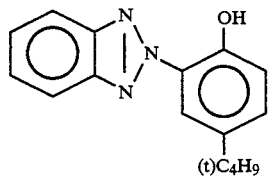

UV-3

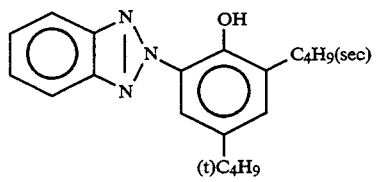

UV-4

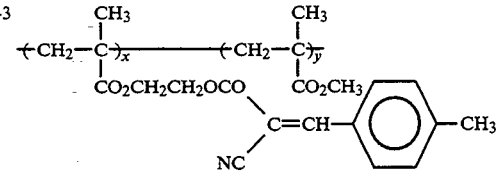

x:y = 70:30 (wt %)

UV-5

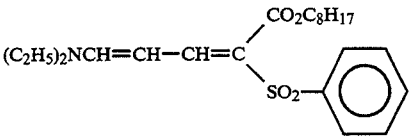

Tricresyl Phospahte Solv-1

Dibutyl Phthalate Solv-2

Solv-4

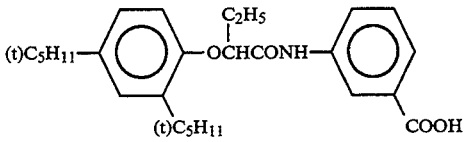

Trihexyl Phosphate Solv-5

Solv-6

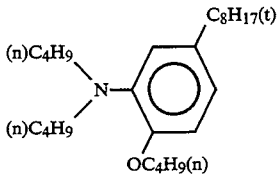

ExF-1

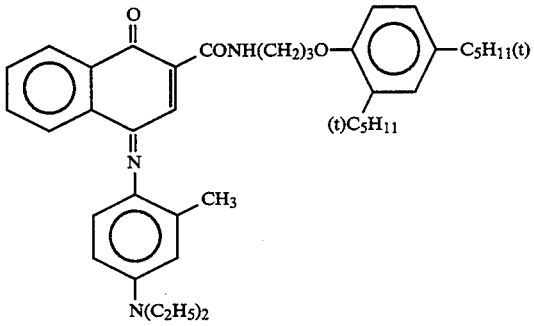

-continued
ExF-2
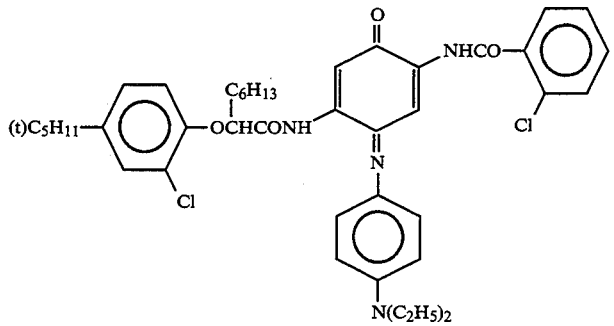
ExF-3
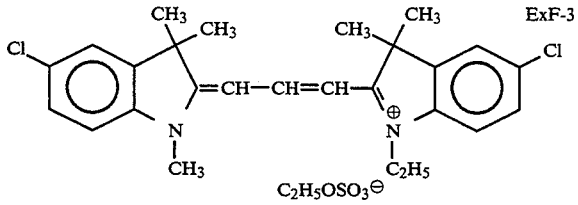
ExC-1
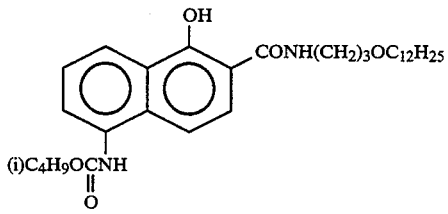
ExC-2
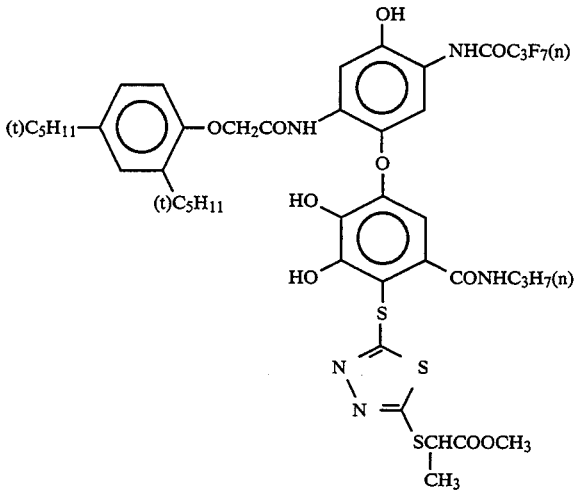
ExC-3
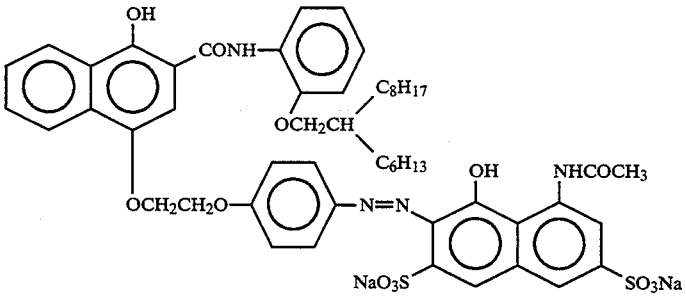
ExC-4
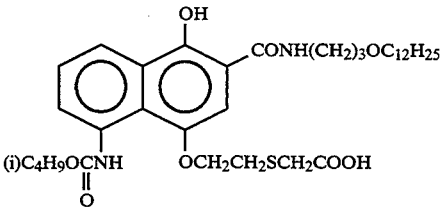

-continued
ExM-5
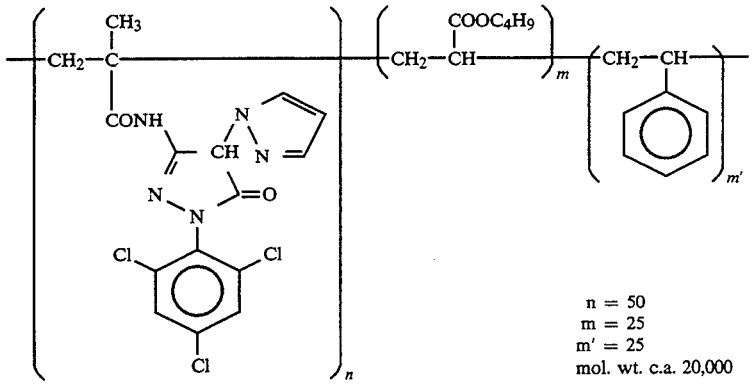
ExM-6
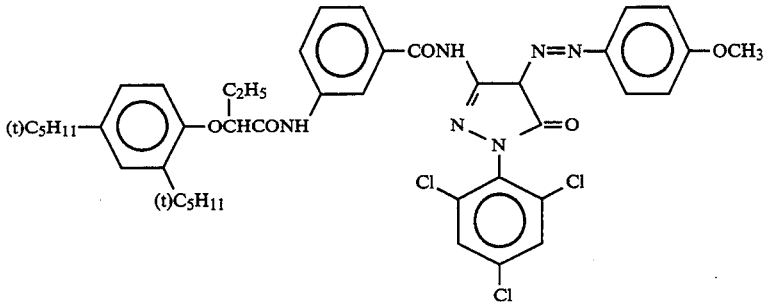
ExM-7
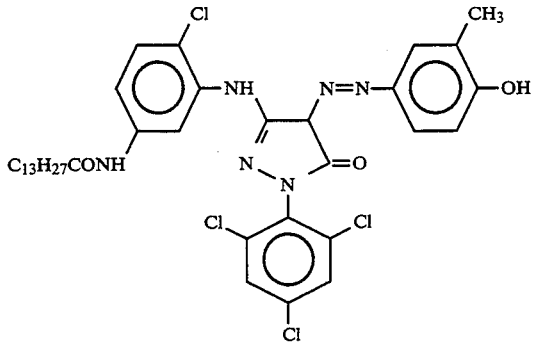
ExM-10
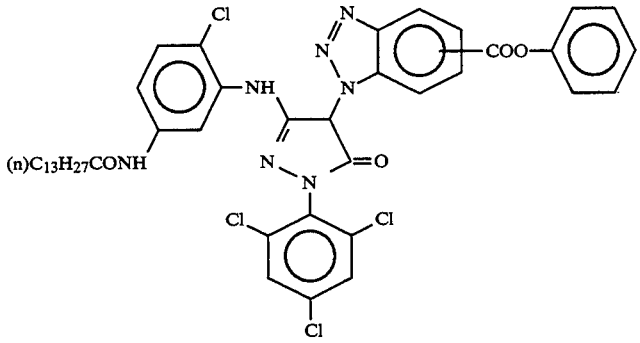

-continued
ExY-8
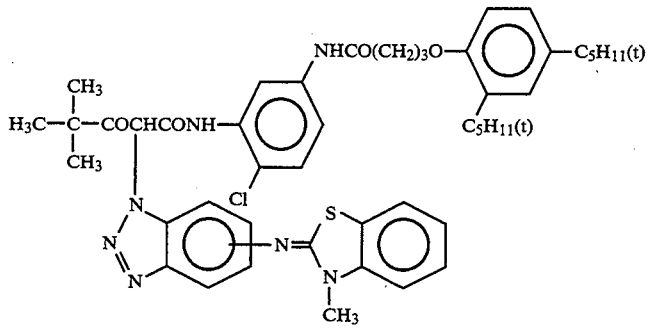
ExY-9
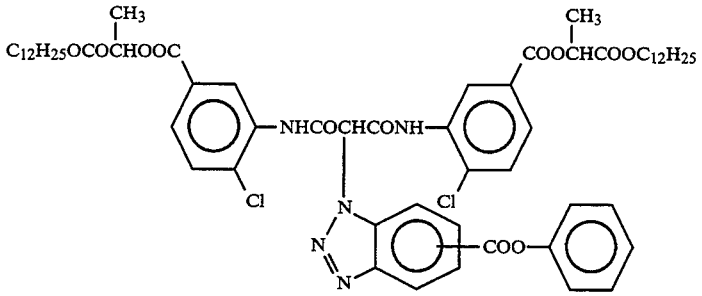
ExY-11
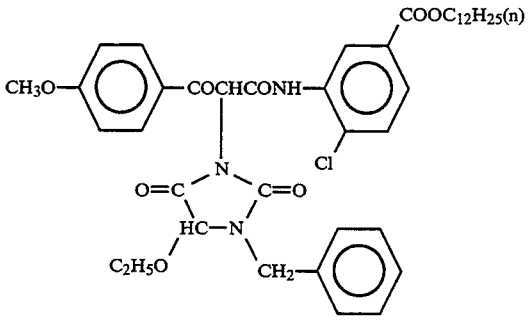
ExY-12
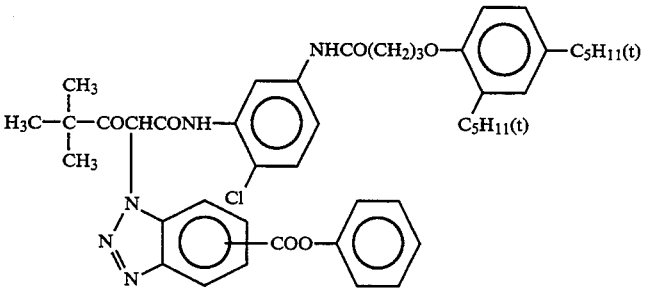
Cpd-1
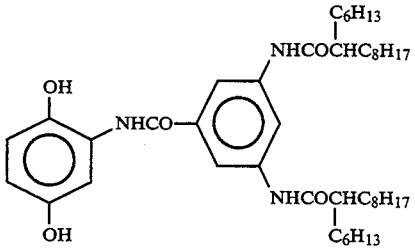
Cpd-2
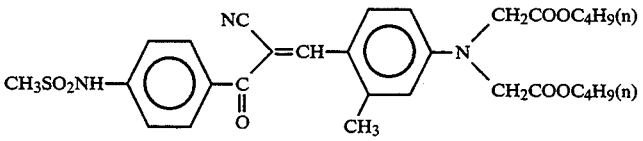

-continued
Cpd-5
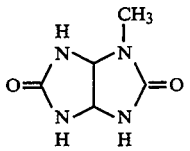
Cpd-6
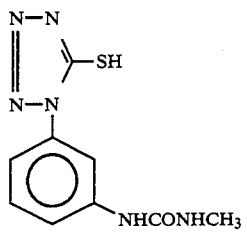
Cpd-8
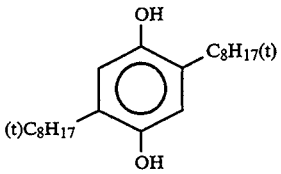
H-1
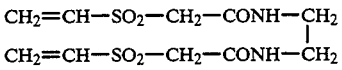
W-1
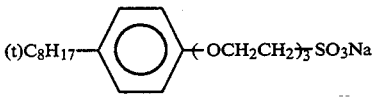
W-2
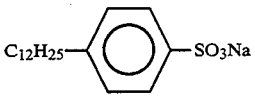
W-3
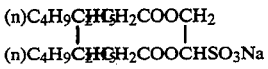
W-4
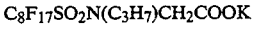
ExS-1
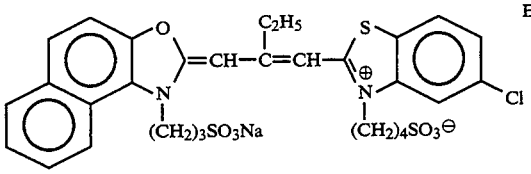
ExS-2
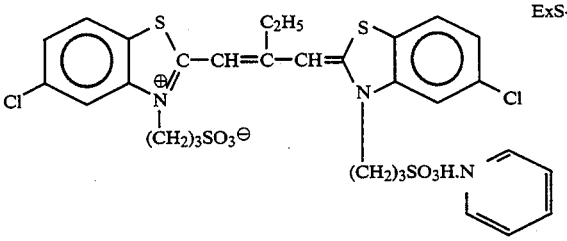
ExS-3
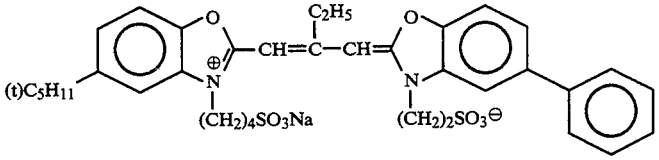
ExS-4
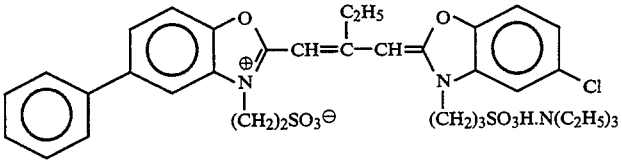
ExS-5
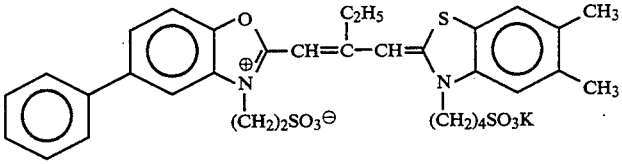
ExS-6
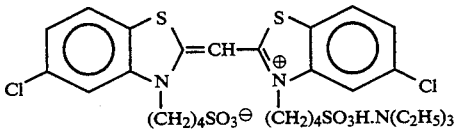
ExS-7
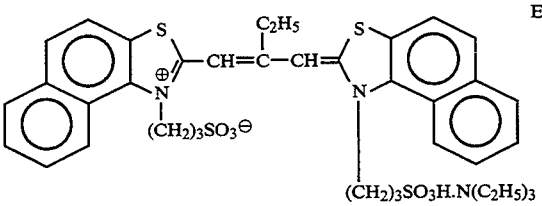

-continued
ExS-8
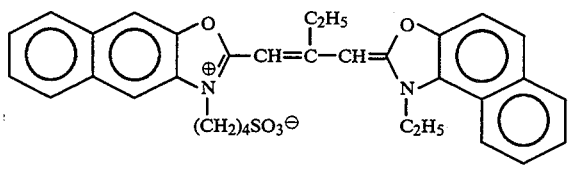
F-1
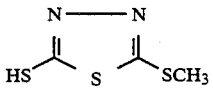
F-2
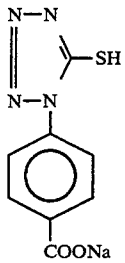
F-3
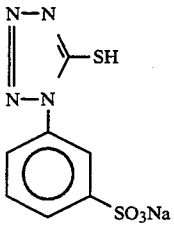
F-4
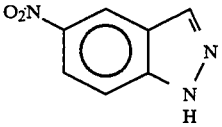
F-5
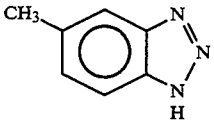
F-6
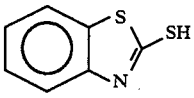
F-7
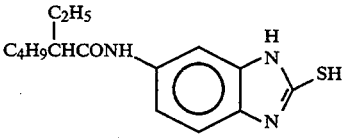
F-8
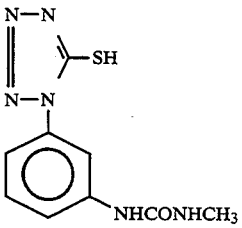
F-9
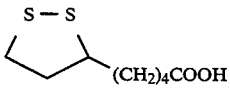
F-10
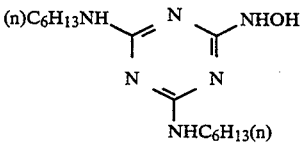
F-11
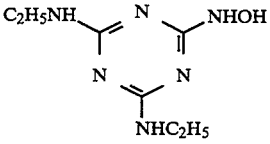
F-12
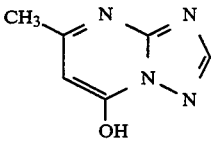
F-13
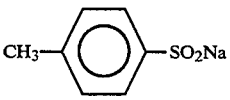
B-1
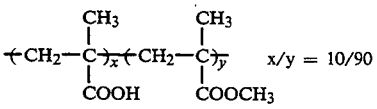
x/y = 10/90
B-2
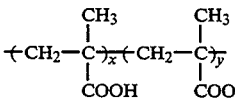
x/y = 40/60
B-3
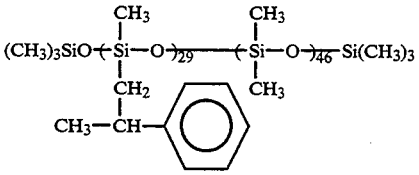

-continued

B-4

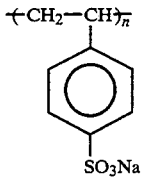

B-5

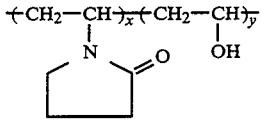

x/y = 70/30

Preparation of Sample Nos. 102 to 112:

Sample Nos. 102 to 112 were prepared in the same manner as Sample No. 101, except that the coupler ExM-10 in the tenth layer (the interlayer effect donor layer to the red-sensitive layer) in Sample No. 101 was changed to that indicated in Table 1 below.

The comparative compounds used had the following chemical structures.

ExM-11:

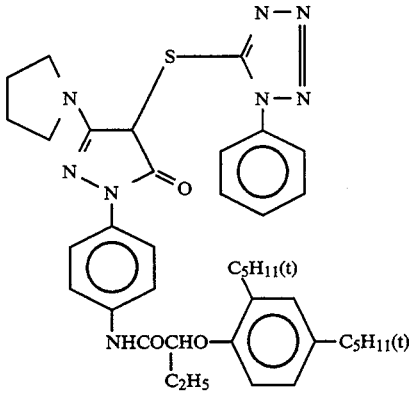

(Coupler C-8, described in U.S. Pat. No. 4,705,744)

ExM-12:

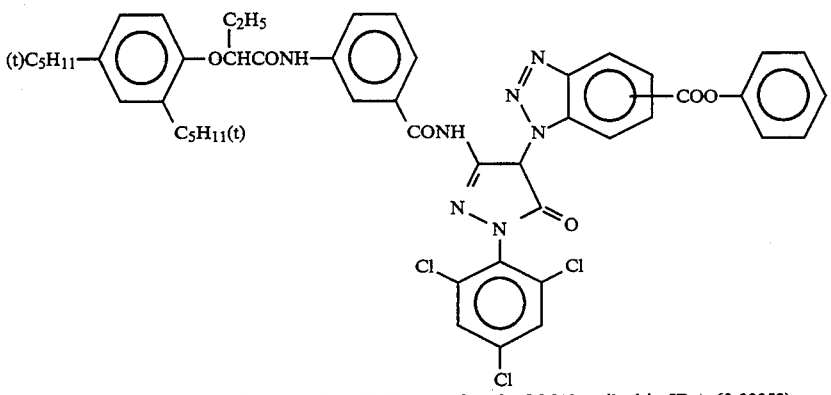

(Coupler D-40 described in U.S. Pat. No. 4,705,744, or Coupler M-8 described in JP-A-63-89850)

ExM-13:

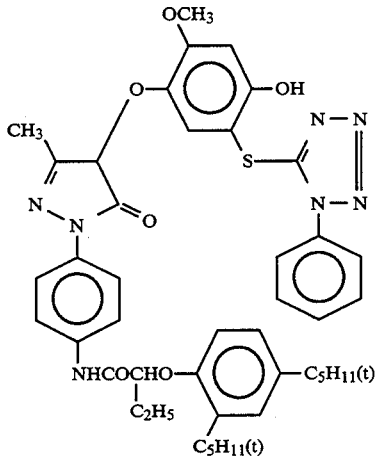

(Coupler (8) described in JP-A-1-164943)

The thus obtained Sample Nos. 101 to 112 were imagewise exposed to take a picture of a female model having a color chart and flowers, with a tungsten light source having a color temperature of 4800° K. adjusted with a filter, and the thus exposed samples were then processed in accordance with the following processing steps at 38° C.

| | |
|---|---|
| Color Development | 3 min 15 sec |
| Bleaching | 6 min 30 sec |
| Rinsing in Water | 2 min 10 sec |
| Fixation | 4 min 20 sec |
| Rinsing in Water | 3 min 15 sec |
| Stabilization | 1 min 05 sec |

The processing solutions used in the above-listed steps had the following compositions.

| | |
|---|---|
| Color Developer: | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-β-hydroxyethylamino)-2-methylaniline Sulfate | 4.5 g |
| Water to make | 1.0 liter |
| pH | 10.0 |
| Bleaching Solution: | |
| Ammonium Ethylenediaminetetra-acetato/Fe(III) Dihydrate | 100.0 g |
| Disodium Ethylenediaminetetraacetate Dihydrate | 10.0 g |
| Ammonium Bromide | 150.0 g |
| Ammonium Nitrate | 10.0 g |
| Water to make | 1.0 liter |
| pH | 6.0 |
| Fixing Solution: | |
| Disodium Ethylenediaminetetraacetate Dihydrate | 1.0 g |
| Sodium Sulfite | 4.0 g |

-continued

| | |
|---|---|
| Ammonium Thiosulfate (aqueous solution, 700 g/liter) | 175.0 ml |
| Sodium Bisulfite | 4.6 g |
| Water to make | 1.0 liter |
| pH | 6.6 |
| Stabilizing Solution: | |
| Formaldehyde (40%) | 2.0 ml |
| Polyoxyethylene-p-monononylphenyl Ether (mean polymerization degree 10) | 0.3 g |
| Water to make | 1.0 liter |

Using the thus obtained negative films, color prints were formed on color papers (Fuji Color Paper) with an enlarging magnification of 6.8 times to obtain photographs. As a result, the photographs as formed on the color papers from the negative films of the present invention had a high picture quality with high color saturation and excellent color hue.

Further, Sample Nos. 101 to 112 were wedgewise exposed white light and then processed in the same manner as described above. The thus processed samples were stored for one week under conditions of a temperature of 80° C. and a relative humidity of 70%, whereupon the variation ($\Delta D_G$) in the minimum magenta density was measured to evaluate the presence of magenta stain in the stored samples. The portion of each of the negative films exposed to a magenta density of (fog+1.0) was printed on a color paper to provide an image having a gray density of about 1.0, whereupon the hue of the image from the highlight portion to the shadow portion was functionally evaluated in relation to fresh samples and samples as stored under the high temperature conditions above. The results obtained are shown in Table 1 below.

TABLE 1

| Sample No. | Compound Added: Name of Compound Added(*) | Compound Added: Amount of Compound Added(**) | Magenta Stain $\Delta D_G$ | Functional Evaluation of Prints |
|---|---|---|---|---|
| 101 (comparison) | ExM-10 | 1.0 | +0.12 | Shadow magenta was noticeable. |
| 102 (comparison) | ExM-11 | 1.3 | +0.14 | " |
| 103 (comparison) | ExM-12 | 1.0 | +0.10 | " |
| 104 (comparison) | ExM-13 | 0.9 | +0.09 | " |
| 105 (Invention) | (6) | 1.2 | +0.03 | No difference between fresh sample and high-temperature stored sample. |
| 106 (Invention) | (13) | 1.4 | +0.02 | No difference between fresh sample and high-temperature stored sample. |
| 107 (Invention) | (24) | 1.0 | +0.01 | No difference between fresh sample and high-temperature stored sample. |
| 108 (Invention) | (1) | 1.2 | +0.01 | No difference between fresh sample and high-temperature stored sample. |
| 109 (Invention) | (5) | 1.1 | +0.00 | No difference between fresh sample and high-temperature stored sample. |
| 110 (Invention) | (19) | 1.3 | +0.02 | No difference between fresh sample and high-temperature stored sample. |
| 111 (Invention) | (26) | 0.8 | +0.02 | No difference between fresh sample and high-temperature stored sample. |
| 112 (Invention) | (35) | 0.9 | +0.01 | No difference between fresh sample and high-temperature stored sample. |

(*) Compound added to Tenth Layer in place of ExM-10.
(**) Molar ratio to ExM-10 of 1.0 mole.

As is obvious from the results in Table 1 above, the photographic material samples of the present invention have an excellent color reproducibility. In addition, where the processed samples of the present invention were stored, only a slight generation of magenta stains occurred and the samples were found to have an excellent hue storability.

EXAMPLE 2

Preparation of Sample No. 201:

Sample No. 201 was prepared in the same manner as Sample No. 108, except for the following changes.

(1) The sensitizing dyes in the Tenth Layer and the amounts thereof were varied as follows:

| | |
|---|---|
| ExS-3 | $2.2 \times 10^{-4}$ |
| ExS-4 | $4.5 \times 10^{-4}$ |

Preparation of Sample No. 202:

Sample No. 202 was prepared in the same manner as Sample No. 108, except for the following changes.

(1) The Tenth Layer was eliminated.

(2) The amount of ExC-1 in each of the Second, Third and Fourth Layers was reduced to 0.9 times the amount in Sample No. 108.

Preparation of Sample No. 203:

Sample No. 203 was prepared in the same manner as Sample No. 108, except for the following changes.

(1) In place of ExS-3 in the Tenth Layer, the following dyes were used.

| | |
|---|---|
| ExS-4 | $4.5 \times 10^{-4}$ |
| ExS-5 | $2.2 \times 10^{-4}$ |

Preparation of Sample No. 204:

Sample No. 204 was prepared in the same manner as Sample No. 108, except for the following changes.

(1) In place of ExS-3 in the Tenth Layer, the following dye was used.

| | |
|---|---|
| ExS-5 | $6.7 \times 10^{-4}$ |

Preparation of Sample No. 205:

Sample No. 205 was prepared in the same manner as Sample No. 108, except for the following changes.

(1) The sensitizing dyes in the Sixth Layer and the amounts thereof were varied as follows:

| | |
|---|---|
| ExS-3 | $4.4 \times 10^{-4}$ |
| ExS-4 | $1.5 \times 10^{-4}$ |
| ExS-5 | Not used |
| ExS-8 | $9.2 \times 10^{-5}$ |

(2) The sensitizing dyes in the Seventh Layer and the amounts thereof were varied as follows:

| | |
|---|---|
| ExS-3 | $6.3 \times 10^{-4}$ |
| ExS-4 | $2.1 \times 10^{-4}$ |
| ExS-5 | Not used |
| ExS-8 | $1.3 \times 10^{-4}$ |

(3) The sensitizing dyes in the Eighth Layer and the amounts thereof were varied as follows:

| | |
|---|---|
| ExS-3 | $4.3 \times 10^{-4}$ |
| ExS-4 | $8.6 \times 10^{-5}$ |
| ExS-5 | Not used |
| ExS-8 | $2.8 \times 10^{-5}$ |

(4) The sensitizing dyes in the Tenth Layer and the amounts thereof were varied as follows:

| | |
|---|---|
| ExS-3 | Not used |
| ExS-5 | $4.0 \times 10^{-4}$ |
| ExS-8 | $2.7 \times 10^{-4}$ |

The thus prepared Sample Nos. 201 to 205 and Sample Nos. 108 to 112 were developed in the same manner as in the development of Sample No. 101, and $\lambda_G$ and $\lambda_{-R}$ were obtained by the method described above. Accordingly, the value of $\overline{\lambda}_G - \overline{\lambda}_{-R}$ was obtained.

Each of these samples was cut to a Leica size for use in a popular camera. A Macbeth Color Rendition Chart was then photographed with a light having a color temperature of 550° K. The photographed samples were then developed in the same manner as described above, and the negatives were printed on Fuji Color Print Papers such that the gray portion of each print having a reflectivity of 18% was the same as the original. The prints were evaluated by functional evaluation. The results obtained are shown in Table 2 below.

TABLE 2

| Sample No. | Compound Used in Tenth Layer | $\lambda_G$/nm | $\lambda_{-R}$/nm | $\lambda_G$-$\lambda_{-R}$/nm | Reproduction of Violet Color (*) Hue | Saturation | Total Evaluation |
|---|---|---|---|---|---|---|---|
| 108 (Invention) | (1) | 549 | 523 | 26 | 5 | 5 | 10 |
| 109 (Invention) | (5) | 548 | 523 | 25 | 5 | 5 | 10 |
| 110 (Invention) | (19) | 551 | 523 | 28 | 5 | 4 | 9 |
| 111 (Invention) | (26) | 552 | 522 | 30 | 5 | 4 | 9 |
| 112 (Invention) | (35) | 550 | 525 | 25 | 5 | 5 | 10 |
| 201 (Invention) | (1) | 548 | 542 | 6 | 5 | 4 | 9 |
| 202 (Invention) | — | 547 | 544 | 3 | 5 | 3 | 8 |
| 203 (Invention) | (1) | 547 | 552 | −5 | 3 | 3 | 6 |
| 204 (Comparison) | " | 545 | 562 | −17 | 2 | 3 | 5 |
| 205 (Comparison) | " | 534 | 575 | −41 | 1 | 3 | 4 |

Functional Evaluation by 10 Panelists:
5: Excellent 4: Good 3: Normal 2: Bad 1: Worst As is obvious from the results in Table 2 above, excellent reproduction of violet and blue flowers was achieved in Sample Nos. 108 to 112 and 201 of the present invention.

In contrast, in Sample No. 202 not having a Tenth Layer (an interlayer effect donor layer to the red-sensitive layer), the saturation of the reproduced image was reduced; and in Sample Nos. 203 to 205 where $\overline{\lambda}_G - \overline{\lambda}_{-R} < 5$ nm, the hue of the reproduced image worsened as the difference in the wavelength between $\overline{\lambda}_G$ and $\overline{\lambda}_{-R}$ increased.

EXAMPLE 3

Preparation of Sample No. 301 (comparison):

Sample No. 301 was prepared in the same manner as Sample No. 101, except for the following changes.

(1) ExY-8 in each of the Seventh and Eighth Layers was replaced by the same molar amount of ExM-10.

(2) The amount of ExM-5 in each of the Seventh and Eighth Layers was reduced from 0.17 to 0.15 and from $9.0\times10^{-2}$ to $7.0\times10^{-2}$, respectively.

Preparation of Sample Nos. 302 to 317:

Samples No. 302 to 317 were prepared in the same manner as Sample No. 301, except that Compound ExM-10 and the amount of the high boiling point organic solvent were varied as indicated in Table 3 below.

The thus prepared Sample Nos. 301 to 317 were wedgewise exposed to white light having a color temperature of 4800° K. adjusted with a filter and then developed in the same manner as for the development of Sample No. 101. The thus processed samples were stored for 2 weeks under conditions of a temperature of 60° C. and a relative humidity of 70%, whereupon the magenta stain generated in the stored samples was determined on the basis of the variation value ($\Delta D_G$) in the minimum magenta density.

The storage stability of the samples was tested as follows: Two of the same sample were simultaneously wedgewise exposed under the same conditions, and one was stored in a freezer for 5 days and the other was stored under conditions of a temperature of 50° C. and a relative humidity of 80% also for 5 days. Both were then processed in the same manner as described above, and the variation in the sensitivity between the samples at the point of a magenta density of 0.8 was determined. The results obtained are shown in Table 3 below.

TABLE 3

| | Compound Used | | | | |
|---|---|---|---|---|---|
| Sample No. | Compound(*) | Amount of Compound(**) | Proportion of High Boiling Point Organic Solvent to Compound(***) | Matenta Stain $\Delta D_G$ | Storage Stability $\Delta S_{0.8}$ |
| 301 (Comparison) | ExM-10 | 1.0 | 1.65 | +0.16 | −0.24 |
| 302 (Invention) | (7)[a] | 0.8 | 1.95 | +0.03 | −0.09 |
| 303 (Invention) | (29)[b] | 1.2 | 1.60 | +0.02 | −0.11 |
| 304 (Invention) | (34)[c] | 0.9 | 1.70 | +0.04 | −0.13 |
| 305 (Invention) | (13) | 1.1 | 1.80 | +0.01 | −0.10 |
| 306 (Invention) | (1) | 1.0 | 1.70 | +0.02 | −0.02 |
| 307 (Invention) | (18) | 1.0 | 1.60 | +0.01 | −0.03 |
| 308 (Invention) | (2) | 1.2 | 1.55 | +0.02 | −0.03 |
| 309 (Invention) | (10) | 1.0 | 1.60 | +0.01 | −0.02 |
| 310 (Invention) | (35) | 0.9 | 1.75 | +0.04 | −0.04 |
| 311 (Invention) | (39) | 0.8 | 1.95 | +0.03 | −0.03 |
| 312 (Comparison) | ExM-10 | 1.0 | 2.30 | +0.21 | −0.23 |
| 313 (Comparison) | ExM-11 | 1.3 | 2.10 | +0.24 | −0.20 |
| 314 (Comparison) | ExM-13 | 0.9 | 2.40 | +0.19 | −0.21 |
| 315 (Invention) | (10) | 1.0 | 2.20 | +0.08 | −0.02 |
| 316 (Invention) | (35) | 0.9 | 2.35 | +0.07 | −0.04 |
| 317 (Invention) | (39) | 0.8 | 2.90 | +0.09 | −0.03 |

(*) Compound used in Seventh, Eighth and Tenth Layers in place of Ex-10.
(**) Molar ratio to Ex-10 of 1.0 mol.
(***) Weight ratio of high boiling point solvent to the compound used in place of Ex-10.
[a]Same compound as Coupler (5) described in JP−A−61−28947.
[b]Same compound as Coupler (51) described in JP−A−62−24252.
[c]Same compound as Coupler (33) described in JP−A−1−164943.

As is obvious from the results in Table 3 above, only slight generation of magenta stain occurred in processed Sample Nos. 302 to 311 and Nos. 315 to 317 of the present invention after storage under high temperature conditions. In particular, it is noted that the generation of magenta stain in Sample Nos. 302 to 311 having a weight ratio of high boiling point organic solvent to compound present in the Seventh, Eighth and Tenth Layers of not more than 2.0 was less than the others. In addition, the samples of the present invention have excellent storage stability after exposure, and the exposed samples of the present invention are not noticeably desensitized, unlike the comparative samples, after storage under high-temperature conditions. From this fact, it is obvious that the samples of the present invention have an improved storage stability. In particular, Sample Nos. 306 to 311 of the present invention were quite excellent, having both high storage stability and high color image storability.

From the above-described experimental results, it can be seen that the photographic materials of the present invention have excellent color reproducibility, color image storability and storage stability.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one yellow coupler-containing blue-sensitive silver halide emulsion layer (BL), at least one magenta coupler-containing green-sensitive silver halide emulsion layer (GL) and at least one cyan coupler-containing red-sensitive silver halide emulsion layer (RL); wherein the weight-averaged wavelength of the spectral sensitivity distribution of GL ($\bar{\lambda}_G$) of the photographic material is between 520 nm and 580 nm (520 nm$\leqq\bar{\lambda}_G\leqq$580 nm), the weight-averaged wavelength of the spectral sensitivity distribution of RL ($\bar{\lambda}_R$) of the photographic material is between 590 nm and 650 nm (590 nm$\leqq\bar{\lambda}_R\leqq$650 nm), and the weight-averaged wavelength of the spectral sensitivity distribution of BL ($\lambda_S$) of the photographic material is between 430 nm and 480 nm (430 nm$\leqq\lambda_B\leqq$480 nm); wherein the photographic material satisfies at least one of the following requirements (a), (b) and (c):

(a) the weight-averaged wavelength of the negative interlayer effect relative to RL ($\bar{\lambda}_{-R}$) is between 490 nm and 560 nm$\leqq\bar{\lambda}_{-R}\leqq$560 nm);

(b) the weight-averaged wavelength of the negative interlayer effect relative to GL ($\bar{\lambda}_{-G}$) is selected from at least one of the group consisting of between 400 nm and 500 nm (400 nm$\leqq\bar{\lambda}_{-G}\leqq$500 nm) and between 570 nm and 670 nm (570 nm $\leqq\bar{\lambda}_{-G}\leqq$670 nm); and (c) the weight-averaged wavelength of the negative interlayer effect relative to BL ($\bar{\lambda}_{-S}$) is between 520 nm and 590 nm (520 nm$\leqq\bar{\lambda}_{-B}\leqq$590 nm); and wherein the photographic material comprises at least one compound represented by formula (P-2) or (P-3) in an interlayer effect donor layer to said RL:

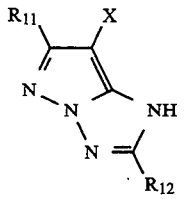

(P-2)

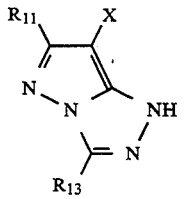

(P-3)

wherein $R_{11}$, $R_{12}$ and $R_{13}$ each represents a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclicoxy group, an azo group, an acyloxy group, a carbamoyloxy group, a silyloxy group, an aryloxycarbamoylamino group, an imido group, a heterocyclicthio group, a sulfinyl group, a phosphonyl group, an aryloxycarbonyl group, an acyl group, or an azolyl group; and X represents a group of formula (X-1):

$$-\{(L_1)_a-(B)_m\}_p-(L_2)_n-DI \quad (X-1)$$

wherein $L_1$ represents a group capable of splitting off from the coupler residual group at the left side bond of $L_1$ in formula (X-1), followed by cleaving the right-side bond of $L_1$, bonding to $(B)_m$, thereof;

B represents a group capable of cleaving the right-side bond of B in formula (X-1) by reaction with an oxidation product of a developing agent;

$L_2$ represents a group capable of .splitting off from the formula (X-1) at the left-side bond of $L_2$ in formula (X-1), followed by cleaving the right-side bond, bonding to DI, thereto;

DI represents a development inhibitor residue;

a, m and n each represent 0 or 1; and p represents an integer of from 0 to 2; provided that when p is 2, then the $\{(L_1)_a-(B)_m\}_p$ groups are the same or different; and wherein a maximum interlayer effect is imparted to said RL at the weight-averaged wavelength $\lambda_R$ by at least one of the layers selected from the group consisting of BL and GL, and wherein the difference between the weight-averaged wavelength in the color sensitivity distribution of GL ($\bar{\lambda}_G$) and the weight-averaged wavelength of the negative interlayer effect relative to RL ($\bar{\lambda}_{-R}$) is 5 nm or more ($\bar{\lambda}_G-\bar{\lambda}_{-R}\leqq$5nm).

2. The silver halide color photographic material as in claim 1, in which a ratio of an amount of a high boiling point organic solvent in the layer or layers imparting a maximum interlayer effect to the cyan-coloring red-sensitive silver halide emulsion layer at the weight-averaged wavelength $\lambda_{-R}$ to the compound of formula (P-2) or (P-3) of claim 1 in the same layer or layers is at most 2.0 by weight.

3. The silver halide color photographic material as in claim 2, in which the group represent by formula (X-1) is a group represented by formula (X-2), (X-3) or (X-4):

$$-(L_1)-(B)-DI \quad (X-2)$$

$$-L_2)-DI \quad (X-3)$$

$$-DI \quad (X-4)$$

where $L_1$ represents a group capable of splitting off from the coupler residual group at the left-side bond of $L_1$ in formula (X-1), followed by cleaving the right-side bond of $L_1$ (bonding to $(B)_m$) thereof;

B represents a group capable of cleaving the right-side bond of B in formula (X-1) by reaction with an oxidation product of a developing agent;

$L_2$ represents a group capable of splitting off from the formula (X-1) at the left-side bond of $L_2$ in formula (X-1), followed by cleaving the right-side bond (bonding to DI) thereto; and DI represents a development inhibitor residue.

4. The silver halide color photographic material as in claim 1, in which $L_1$ and $L_2$ in formula (X-1) each represents a group represented by formula (T-1), (T-2), (T-3), (T-4), (T-5) or (T-6):

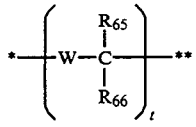

(T-1)

where W represents an oxygen atom, a sulfur atom, or $-N(R_{67})-$;

$R_{65}$ and $R_{66}$ each represents a hydrogen atom, or a substituent;

$\bar{\lambda}_{-R}$ $R_{67}$ represents a substituent;

t represents 1 or 2, and when t is 2, the $(-W-C(R_{65})(R_{66})-)$ groups are the same or different; and the symbol (*) indicates the left-side bond of $L_1$ or $L_2$ in formula (X-1), and the symbol (**) indicates the right-side bond of $L_1$ or $L_2$ in formula (X-1);

$$*-Nu-Link-E-** \quad (T-2)$$

where the symbols (*) and (**) have the same meaning as in formula (T-1);

Nu represents a nucleophilic group;

E represents an electrophilic group, which is a group nucleophilically attacked by Nu to cleave the bond (**); and Link represents a linking group for sterically linking Nu and E with each other so that an intramolecular nucleophilic substitution reaction may occur therebetween;

$$*\text{—W—}(V_1{=}V_2)_t\text{—}CH_2\text{—}** \qquad \text{(T-3)}$$

where $V_1$ and $V_2$ each represents $=C—R_{65}$ or a nitrogen atom; and (*), (**), W, $R_{65}$ and t have the same meaning as in formula (T-1);

$$*\text{—O—CO—}** \qquad \text{(T-4)}$$

$$*\text{—S—CS—}** \qquad \text{(T-5)}$$

where (*) and (**) have the same meaning as in formula (T-1);

$$*\text{—W—C}(=\text{N—}R_{68})\text{—}** \qquad \text{(T-6)}$$

where (*), (**) and W have the same meaning as in formula (T-1); and $R_{68}$ has the same meaning as $R_{67}$ as defined in formula (T-1).

5. The silver halide color photographic material as in claim 1, in which X represents a group which splits off from the formula (P-2 or P-3) via an oxygen atom and $R_{11}$ represents a hydrogen atom, an alkyl group or an aryl group.

6. The silver halide color photographic material as in claim 1, in which B in formula (X-1) is represented by formula (B-1), (B-2), (B-3) or (B-4):

$$*\text{—}X_1\text{—}(X_2{=}X_3)_b\text{—}X_4\text{—H} \qquad \text{(B-1)}$$

** where the symbol (*) represents the position which is bonded to the left side of B in formula (X-1); the symbol () represents the position which is bonded to the right side of B in formula (X-1); $X_1$ and $X_4$ each represents an oxygen atom or $=N—SO_2R_{71}$ (where $R_{71}$ represents an aliphatic group, an aromatic group or a heterocyclic group); $X_2$ and $X_3$ each represents a methine group or a nitrogen atom; and b represents an integer of from 1 to 3; provided that at least one of the $(X_2)$'s in b and the $(X_3)$'s in b is a methine group with the bond (), where b is a plural number, the $(X_2)$'s and the $(X_3)$'s are the same or different and where $X_2$ and $X_3$ each is a substituted methine group or bonded to each other to form a cyclic structure.

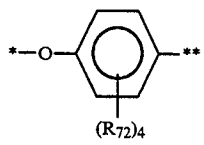

(B-2)

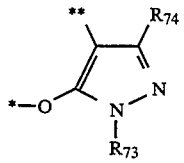

(B-3)

where the symbols (*) and () have the same meaning as in formula (B-1); $R_{72}$, $R_{73}$ and $R_{74}$ each represents a group which may function as a coupler having a coupling split-off group at the position (), after the group of formula (B-2) or (B-3) has cleaved at the position (*); and d represents an integer of from 0 to 4; provided that when d is a plural number, the $(R_{72})$'s may be the same or different and where plural $(R_{72})$'s are present, they are bonded to each other to form a cyclic structure:

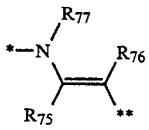

(B-4)

where the symbols (*) and (**) have the same meaning as in formula (B-1); and $R_{75}$, $R_{76}$ and $R_{77}$ each represents a substituent, and $R_{77}$ and $R_{76}$ may be bonded to each other to form a nitrogen-containing heterocyclic ring.

7. The silver halide color photographic material as in claim 6, in which B in formula (X-1) is represented by formula (B-1) having a substituent with a Hammett's $\sigma_p$ value of 0.3 or more.

* * * * *